US007696110B2

(12) United States Patent
Taniguchi et al.

(10) Patent No.: US 7,696,110 B2
(45) Date of Patent: Apr. 13, 2010

(54) SHEET MATERIAL FOR SEAT

(75) Inventors: Yukihito Taniguchi, Moriyama (JP); Hiroshi Yamazaki, Ibaraki (JP)

(73) Assignee: Asahi Kasei Fibers Corporation, Osaka-Shi (JP)

( * ) Notice: Subject to any disclaimer, the term of this patent is extended or adjusted under 35 U.S.C. 154(b) by 158 days.

(21) Appl. No.: 10/962,661

(22) Filed: Oct. 13, 2004

(65) Prior Publication Data

US 2005/0142970 A1 Jun. 30, 2005

(30) Foreign Application Priority Data

Oct. 14, 2003 (JP) ..... 2003-353632

(51) Int. Cl.

| | |
|---|---|
| ***D04B 1/00*** | (2006.01) |
| ***D04B 1/14*** | (2006.01) |
| ***D04B 21/14*** | (2006.01) |
| ***D04B 21/00*** | (2006.01) |
| ***D04B 7/04*** | (2006.01) |

(52) U.S. Cl. ..... 442/304; 442/311; 442/312; 442/313; 442/314; 66/195; 66/196; 66/197

(58) Field of Classification Search ..... 442/304, 442/308; 66/196

See application file for complete search history.

(56) References Cited

U.S. PATENT DOCUMENTS 6,630,414 B1 * 10/2003 Matsumoto ..... 442/1
6,644,070 B2 * 11/2003 Ikenaga et al. ..... 66/196

FOREIGN PATENT DOCUMENTS

| | | |
|---|---|---|
| JP | 2001-303395 | 10/2001 |
| JP | 2001-314287 | 11/2001 |
| JP | 2002-339205 | 11/2002 |
| WO | WO 02/079558 A1 | 10/2002 |

* cited by examiner

*Primary Examiner*—Elizabeth M Cole
*Assistant Examiner*—Jennifer Steele
(74) *Attorney, Agent, or Firm*—Finnegan, Henderson, Farabow, Garrett & Dunner, L.L.P.

(57) ABSTRACT

A sheet material for a seat characterized in that the stress at 5% elongation (A) is from 40 to 300 N/4 cm width wherein A is a larger value between a stress measured in the longitudinal direction and a stress measured in the lateral direction, that the ratio A/B is from 1.5 to 15.0 wherein B is the smaller value obtained in the above measurement, and that the reduction in width (H) is from 0 to 15% when the sheet material is fixed on a frame at the one end and the opposite end while stretched and pressured.

10 Claims, 2 Drawing Sheets

(1)

(2)

SHEET MATERIAL FOR SEAT

FIELD OF THE INVENTION

The present invention relates to a sheet material for seats in automobiles, railway vehicles, aircraft, and the like.

PRIOR ART

When a woven or knitted fabric formed out of elastic fiber such as polyester elastomer fiber or poly(trimethylene terephthalate) fiber is stretch placed on a frame, a seat that is capable of manifesting cushioning properties by utilizing the elongation recovery of the elastic fiber, and that is thin, lightweight, highly air permeable, and the like, in comparison with a metal spring and a urethane cushioning material can be obtained. Such a woven or knitted fabric composed of elastic fiber has been called a fabric spring, and has been used for many seat applications such as office chairs and furniture.

Japanese Unexamined Patent Publication (Kokai) No. 2001-159052 proposes an appropriate elastic woven or knitted fabric that is prepared by providing stress during stretching and a residual strain after repeated deformation in proper ranges and heat melt sticking the elastomer fiber at the intersections of the woven or knitted fabric and, as a result, that shows excellent elasticity and elastic recovery without stitch shifts and is appropriate to a cushioning material. However, although the woven or knitted fabric described in the reference is reinforced by heat melt sticking at the intersections, the resistance to tearing is insufficient, and a hole formed by a cigarette and a cut formed by a blade tend to extend. Users therefore entertain deep apprehensions about the strength.

On the other hand, Japanese Unexamined Patent Publication (Kokai) Nos. 2001-87077 and 2002-219985 describe applications of a three-dimensional knitted fabric formed out of a knitted fabric having front and back side double layers and a connecting yarn connecting the double layer knitted fabric to a sheet material for a seat, and the like, as a cushioning material having functions such as recyclability, air-permeability and vibration absorbing properties. For example, the patent publications disclose a seat prepared by stretching, on a seat frame, a three-dimensional knitted fabric in which an upper mesh layer and lower mesh layer are connected with a connecting yarn.

However, because the three-dimensional knitted fabric is likely to be deflected, when one sits thereon, due to the elongation of the front and back side knitted fabrics, shifts among yarns caused by deformation of the front and back side stitches or deformation of the front and back side mesh shapes are hardly recovered instantaneously although a suitable fitting feeling can be obtained. As a result, the cushioning properties are not satisfactory. For example, the deflection is not recovered adequately, and a resilient feeling gradually lowers when one repeatedly sits thereon. Moreover, the initial tensile stress characteristics in the longitudinal and lateral directions and an elongation balance between the front and back side knitted fabrics are not considered. For example, when a three-dimensional knitted fabric is stretch placed and fixed at two opposite sides and used, a shape change caused by reduction in width in the unfixed direction takes place during sitting. As a result, the following problem arise: one sitting on the seat has an unpleasant feeling (e.g., the sense that one sits on foreign matter due to an upthrust of the knitted fabric in the gap between the buttocks), and one sags deep in the seat so that one's sitting is impaired. Moreover, the strength of the knitted fabric has been insufficient when a defect is formed with a blade, or the like tool.

Japanese Unexamined Patent Publication (Kokai) No. 2003-003354 discloses a three-dimensional structure knitted fabric for a seat that shows an improved recovery after removal of a load even when the knitted fabric has once been deflected with a load applied thereto in the vertical direction, and a decreased change in a resilient feeling even when a load is applied repeatedly, because an insertion yarn is linearly inserted into the front and back side surface of the knitted fabric.

However, the initial tensile stress characteristics in the longitudinal and lateral directions of the three-dimensional knitted fabric, and the balance between the elongation of the front side knitted fabric and that of the back side one are not taken into consideration when the knitted fabric is used while being stretched and fixed at two sides, although cushioning properties with a resilient feeling and a recovery are improved. As a result, the following problem arises: a feeling of touching the bottom caused by an insufficient cushioning effect of the connecting yarn cannot be made disappear, and a stable sitting feeling cannot be obtained due to insufficient fitting properties. Furthermore, because knitting consideration such as insertion stitch and yarn use are not adequately considered, lateral wrinkles tend to be formed in the three-dimensional knitted fabric, and the knitted fabric has a poor appearance.

DISCLOSURE OF THE INVENTION

Problems to be Solved by the Invention

An object of the present invention is to solve problems related to conventional technologies as explained above, and provide a sheet material for a seat which has a high resistance to tearing, in which a hole formed by a cigarette or a defect formed by a blade, or the like tool, hardly extends (highly safe sheet material), which is excellent in fitting properties with respect to a human body, which achieves a stable and good comfortable sitting feeling due to a decreased reduction in width, and which shows a good elongation recovery.

Means for Solving the Problems

As a result of intensively carrying out investigations to solve the above problems, the inventors have discovered that the above problems can be solved by specifying stretching characteristics in the longitudinal and lateral directions of the sheet material, a reduction in width, tearing characteristics, a fiber material and a fiber shape used for the sheet material, a knitting method, and the like, and further specifying a balance between a surface elongation of the front side knitted fabric and a surface elongation of the back side knitted fabric when the front side and the back side of the three-dimensional knitted fabric are separated, a fiber material and a fiber shape used therefor, a knitting method, laying spread compression characteristics, and the like, and they have thus achieved the present invention.

That is, the present invention is as described below.

1. A sheet material for a seat characterized in that the stress at 5% elongation (A) is from 40 to 300 N/4 cm width wherein A is a larger value between a stress measured in the longitudinal direction and a stress measured in the lateral direction, that the ratio A/B is from 1.5 to 15.0 wherein B is the smaller value obtained in the above measurement, and that the reduction in width (H) is from 0 to 15% when the sheet material is fixed on a frame at the one end and the opposite end while stretched and pressured.

2. The sheet material for a seat according to 1 described above, wherein the sheet material is formed out of a woven fabric.

3. The sheet material for a seat according to 1 described above, wherein the sheet material is formed out of a knitted fabric.

4. The sheet material for a seat according to 1 described above, wherein the sheet material is a three-dimensional knitted fabric having front and back double layer knitted fabrics and a connecting yarn that connects the double layer knitted fabrics.

5. The sheet material for a seat according to 4 described above, wherein the connecting yarn is a monofilament.

6. The sheet material for a seat according to any one of 3 to 5 described above, wherein an insertion yarn is used in at least a portion of the knitted fabrics.

7. The sheet material for a seat according to any one of 3 to 6 described above, wherein the ground structure forming the knitted fabric is formed out of a combined texture of chain stitch and tricot knitting of 3-8 needle shogging, and the insertion yarn is warp yarn inserted in the direction equal to or reverse to the underlap direction of tricot knitting of the ground structure with a shogging width of 3 needle shogging or less per course.

8. The sheet material for a seat according to 6 or 7 described above, wherein the insertion yarn is a monofilament of 300 to 3,000 dtex.

9. The sheet material for a seat according to any one of 1 to 8 described above, wherein the penetration strength (G) is 3,000 N or more when the sheet material is fixed on a frame while stretched and pressured.

10. The sheet material for a seat according to any one of 4 to 9 described above, wherein the sheet material is a three-dimensional knitted fabric that shows a ratio (F/D) of a surface elongation (F) of a front side knitted fabric to a surface elongation (D) of a back side knitted fabric of 1.5 to 10.0.

11. The sheet material for a seat according to 10 described above, wherein the sheet material is a three-dimensional knitted fabric showing a laying spread compression modulus of 20 to 150 N/mm.

12. The sheet material for a seat according to 10 or 11 described above, wherein the sheet material is a three-dimensional knitted fabric for which a poly(trimethylene terephthalate) monofilament is used as a connecting yarn.

13. A seat characterized in that the seat is formed out of the sheet material for a seat according to any one of 1 to 12 described above.

14. A seat characterized in that one or at least two materials selected from a urethane foam, a nonwoven fabric cushioning material, a thermoplastic resin foam material and a skin material are used in at least a portion of the seat, and that the seat is a laminate of the one or at least two materials and the sheet material for a seat according to any one of 1 to 12 described above.

15. A vehicle having a seat according to 13 or 14 described above.

The present invention will be explained below in detail.

The sheet material for a seat of the invention is stretched on a frame having any of the various shapes such as an approximately a quadrangle shape and a polygonal shape by various methods such as stitching, resin molding or bolting to form a plane cushioning material. The sheet material thus formed manifests cushioning properties when one sits thereon by utilizing the stretching characteristics thereof.

Although the cushioning material can be formed by stretching the sheet material for a seat of the invention alone on a frame of various shapes, one or at least two materials selected from a urethane foam, a nonwoven fabric cushioning material, a thermoplastic resin foam material and a skin material are optionally used in at least a portion of the sheet material, and a laminate of the one or at least two materials and the sheet material for a seat of the invention is stretched on the frames of various shapes to form the cushioning material.

The sheet material for a seat of the invention shows a stress at 5% elongation (A) of from 40 to 300 N/4 cm width, preferably from 70 to 270 N/4 cm width, and more preferably from 100 to 250 N/4 cm width wherein A is a larger value measured in the longitudinal or lateral direction, and has a ratio A/B of from 1.5 to 15.0, preferably from 1.5 to 10.0, and more preferably from 2.0 to 8.0 wherein B is the smaller value obtained in the above measurement.

When the stress at 5% elongation in the A direction of the sheet material for a seat exceeds 300 N/4 cm, the resultant seat is deteriorated in soft resilience when sitting thereon, and the sheet surface hardly fits the body. As a result, the sheet material has a hard feel and gives a poor sitting feeling.

In addition, the A direction designates a direction having a larger stress value at 5% elongation measured in the longitudinal or lateral direction.

When the stress at 5% elongation in the A direction is less than 40 N/4 cm, the resultant seat shows excessively weak resilience when sitting, and the sheet material gives a poor resilient feeling when sitting and shows a poor recovery and deteriorated cushioning properties. Moreover, the reduction in width of a seat that is stretched by two-opposite-side fixing becomes excessively large, and an unpleasant feeling in the buttocks (e.g., the sense that one sits on foreign matter due to an upthrust of the knitted fabric in the gap between the buttocks) is given. As a result, a stable sitting feeling cannot be obtained.

When the ratio (A/B) of a stress at 5% elongation in the A direction to a stress at 5% elongation in the B direction is outside the range of from 1.5 to 15.0, the fitting properties, to a human body, are deteriorated, and the sitting feeling becomes poor.

When a sheet material for a seat is stretched by two-opposite-side fixing to form a seat, the two sides at both ends in the A direction are preferably fixed to the frame.

The reduction in width (H), when a sheet material for a seat of the invention is fixed on a frame at the one end and the opposite end while stretched and pressured, must be from 0 to 15%, preferably from 0 to 10%, and more preferably from 0 to 5% in order to improve the fitting properties during sitting and make an uncomfortable feeling in the buttocks disappear. When H comes nearer to 0%, a more stable sitting feeling can be obtained.

Even when a opening is formed with a cigarette or a blade or the like tool in the sheet material for a seat of the invention, the sheet material must be highly safe against ready spreading of the opening with a weight or an impact load. In order to support a bodyweight and obtain great safety, a penetration strength (G), explained below, is preferably 3,000 N or more, more preferably 4,000 N or more, and still more preferably 5,000 N or more. G shows a degree of resistance to tearing of an opening of a stretched sheet material for a seat having a hole 1.5 cm in diameter (defect) that is formed in advance, when a load is applied to the sheet material for a seat with a metal-made semispherical compressive jig 100 mm in diameter, in a state that the sheet material is fixed on a frame while stretched. A higher penetration strength (G) is more preferred as long as the sheet material can be produced.

The sheet material for a seat of the present invention is mainly formed out of a woven fabric or knitted fabric. However, in order to obtain great safety from tearing of a defect produced in the sheet and a more stable sitting feeling, the sheet material is preferably a knitted fabric, more preferably a warp knitted fabric, and still more preferably a three-dimensional knitted fabric having front and back side double layer knitted fabrics.

The sheet material for a seat of the present invention is preferably a knitted fabric which is formed out of a knitted loop stitch of at least two guide bars and the ground structure of which is composed of a yarn having a size of from 300 to 2,000 dtex. Moreover, the product of a number of courses and a number of wales of the knitted fabric is preferably from 100 to 600. When the size of a yarn forming the ground structure is from 300 to 2,000 dtex, and the product of a number of courses and a number of wales is from 100 to 600, the knitted fabric has the following advantages: the tear resistance is excellent; the deformation of stitch (texture deformation) is small; the elongation is suitable and the recovery is good; and the knittability is good. Moreover, when the ground structure is a knitted fabric formed out of a knitted loop stitch of at least 2-guide bars, the tear resistance is excellent.

For a knitted fabric, the size of a yarn forming the ground structure is preferably from 430 to 1,500 dtex, more preferably from 450 to 1,300 dtex in view of improving the tear resistance. Moreover, the product of a number of courses and a number of wales of the knitted fabric is preferably from 120 to 500, and more preferably from 150 to 400.

The sheet material for a seat of the present invention is preferably a knitted fabric formed out of a ground structure composed of a knitted loop stitch of at least two guide bars. The knitted loop stitch herein designates a knitting stitch forming knitted loops without fail such as chain knitting and tricot knitting. In this case, in order to more improve the tear resistance, at least one guide bar is preferably made tricot knitting of multi-needle shogging, and the shogging width of the multi-needle shogging is preferably from three to eight needle shogging. In order to obtain a knitted fabric that further suppresses stitch deformation (texture deformation) and shows a good elongation recovery in addition to the tear resistance, at least one guide bar of the ground structure is preferably made chain knitting. Furthermore, a knitted fabric showing a sufficient tear resistance and an adequate elongation recovery can be obtained by entanglement of an insertion yarn in the ground structure of the at least two guide bars.

For the knitting stitch of the sheet material for a seat of the invention, in order to make the stress (A) at 5% elongation in the A direction 40 N/4 cm width or more, an insertion yarn is preferably inserted in the longitudinal direction and/or in the lateral direction so that the knitting stitch has a decreased stitch deformation (texture deformation).

When an insertion yarn is inserted in the longitudinal direction, the insertion yarn is preferably inserted over the entire length in a linear shape or in a shape close to zigzag shape, in a state in which the yarn is inserted with a shogging width of at least three needle shogging per course between a needle loop and a sinker loop of a ground yarn knitted with a stitch such as chain stitch or tricot knitting, or in a state in which the yarn is inserted with up-and-down movements among sinker loops of the ground yarn ranging in the longitudinal direction of the knitted fabric.

One of the methods of inserting an insertion yarn is to insert the yarn in accordance with the knitting stitch when the yarn is inserted in the longitudinal direction. In order to suppress the deformation of the stitch (texture deformation) during the insertion, the yarn is preferably inserted in the direction reverse to the underlap direction of tricot knitting with multi-needle shogging in the ground structure. The shogging width is preferably three needle shogging or less, and more preferably two needle or one needle shogging per course. When the yarn is inserted in the lateral direction, a weft yarn can be inserted with a single raschel knitting machine or a double raschel knitting machine equipped with a weft yarn insertion apparatus.

Examples of fiber used for the ground structure or the insertion yarn of the sheet material for a seat of the present invention include a synthetic fiber such as poly(ethylene terephthalate) fiber, poly(trimethylene terephthalate) fiber, poly(butylene terephthalate) fiber, polyester elastomer fiber, polyamide fiber, polyacrylic fiber and polypropylene fiber, natural fiber such as cotton fiber, hemp fiber and wool fiber, regenerated fiber such as cuprammonium rayon fiber, viscose rayon fiber and lyocell fiber, and freely selected fiber.

The cross-sectional shape of the yarn may be a polygonal shape such as a circular shape, a triangular shape, an L shape, a T shape, a Y shape, a W shape, an eight-leaf shape, a flat shape or a dog bone shape, a multi-leaf shape, a hollow shape and an indefinite shape. The yarn may be selected from any of the following types: a non-textured yarn; a spun yarn; a twisted yarn; a false-twisted yarn; an air-jet injection textured yarn; and the like yarn. Moreover, for a yarn such as multifilaments yarn, a size from 300 to 2,000 dtex can be usually employed. A single filament size can be freely selected.

For a yarn used for the ground structure of the sheet material for a seat, the yarn preferably shows a dry heat shrinkage at 150° C. of from 5 to 20%, and more preferably from 7 to 17% because the stitches are tightened and the elongation is suppressed without texture deformation during finish texturing. Moreover, a raw yarn (non-textured yarn) showing a dry heat shrinkage at 150° C. of from 5 to 20% is preferably used as at least one of the yarns used for the ground structure.

Elastic fiber such as poly(trimethylene terephthalate) fiber or polyester elastomer fiber is preferably used as the insertion yarn because the yarn improves an elongation recovery and suppresses a plastic deformation after one sits on the sheet material for a long time. The insertion yarn is preferably a monofilament having a size of from 300 to 3,000 dtex because the yarn suppresses a local sag, produced when a person sits on the sheet material, and imparts surface stiffness that gives a stabile sitting feeling. Moreover, when the insertion yarn is a monofilament, the monofilament may be bonded to the ground structure in order to prevent a texture deformation caused by slippage of the monofilament from the ground structure, or plastic deformation after sitting. A heat melt sticking method wherein a three-dimensional knitted fabric knitted with a sheath-core monofilament having a low-melting point polymer sheath covering the monofilament surface is melt stuck by heat setting is preferably used as the bonding method.

Forming the sheet material for a seat out of polyester fiber in an amount of 100% is preferred because the sheet material can be recycled as a monomer by depolymerizing the sheet material when the sheet material is disposed as a waste material, and because generation of a harmful gas can be prevented even when the sheet material is incinerated.

The sheet material for a seat of the invention is preferably prepared by knitting with a single raschel knitting machine or a double raschel knitting machine. The gauge of the knitting machine is preferably from 9 to 28 gauges.

Although the fabric weight of the sheet material for a seat can be freely determined according to the purpose of use, it is preferably from 300 to 2,000 g/m$^2$, more preferably from 400 to 1,500 g/m$^2$.

In addition, the sheet material for a seat of the present invention must have a strength that can support a body weight while the sheet material is in a stretch placed state and that can adequately resist the behavior of pushing the sheet material with the knees or impact force applied during collision or the like. The breaking strength is therefore preferably 140 N/cm or more in the longitudinal and lateral directions, more preferably 150 N/cm or more, and still more preferably 170 N/cm or more.

In order to make the breaking strength of the sheet material for a seat in the longitudinal and lateral directions 140 N/cm or more, it is preferred that the knitted fabric be formed by using in at least one portion of the ground structure a yarn having a strength of preferably 4 cN/dtex or more, more preferably 5 cN/dtex or more, and still more preferably 6 cN/dtex or more.

The sheet material for a seat of the invention is preferably a three-dimensional knitted fabric. Use of the three-dimensional knitted fabric improves the cushioning properties, tear resistance and vibration attenuation.

When the sheet material for a seat composed of the three-dimensional knitted fabric of the invention is used for a seat of stretch placing type, in order to make the cushioning properties better in the thickness direction, produced by the connecting yarn of the three-dimensional knitted fabric, the ratio (F/D) of a surface elongation (F) of the front side knitted fabric to a surface elongation (D) of the back side knitted fabric is preferably from 1.5 to 10.0, more preferably from 2.0 to 9.0, and still more preferably from 3.0 to 8.0. The front side knitted fabric herein designates the side used as the surface side in the final product. When the final product is indefinite, any side of the three-dimensional knitted fabric may be taken as the front side. Moreover, the surface elongation is a value obtained by the following procedure: the three-dimensional knitted fabric is separated into a front side knitted fabric and a back side knitted fabric; a load of 245 N is applied to each fabric that is in a state of being stretch placed on a frame, in the vertical direction of the knitted fabric with a compression jig 100 mm in diameter, and the surface is a degree of elongation of the knitted fabric in the surface direction.

When the surface elongation ratio (F/D) is less than 1.5, the front side knitted fabric of the sheet material stretch placed on a frame principally supports a sitting weight. As a result, the cushioning properties of the connecting yarn of the three-dimensional knitted fabric are hardly displayed, and the cushioning properties and fitting properties are deteriorated. The sitter therefore tends to have an uncomfortable sitting feeling. Moreover, when the surface elongation ratio exceeds 10, the front side knitted fabric in the seat (stretch placed sheet material on a frame) is likely to be stretched, and the connecting yarn becomes in an unstable state. As a result, the cushioning properties tend to be deteriorated due to the lying down of the connecting yarn and the sitter tends to have an unpleasant feeling in the buttocks. The sitter is therefore likely to have an uncomfortable sitting feeling. Such a surface elongation ratio can be obtained by, for example, making the knitting stitch of the front side knitted fabric and that of the back side knitted fabric differ from each other, and suitably selecting each knitting stitch and yarn use therein on the front side and back side knitted fabrics. Furthermore, because the surface elongation ratio tends to be influenced by a dry heat shrinkage of the yarn material, it is preferred that the dry heat shrinkage and the knitting stitch be fully considered so that the surface elongation ratio of the front side and back side knitted fabrics falls in a proper range.

A monofilament yarn is preferably used as the connecting yarn connecting the front and back double layer knitted fabric of the three-dimensional knitted fabric. When the three-dimensional knitted fabric is knitted with a double raschel knitting machine, a double tubular knitting machine, a flat knitting machine, or the like machine, the connecting yarn connecting the front and back side knitted fabrics is knitted into the knitted fabric while the connecting yarn is in a bent state without fail in one of the two directions. When a force is applied to the connecting yarn in the thickness direction, the bent state is further bent, and the state is recovered when the force is removed. Because the behavior of bending and recovery produced during the procedure greatly influences the cushioning properties with a resilient feeling of the three-dimensional knitted fabric, use of a monofilament having a high bending stiffness as the connecting yarn is preferred. The cushioning properties are also reflected when the three-dimensional knitted fabric is used as a seat of stretch placing type. Accordingly, use of a monofilament for the entire connecting yarns of the three-dimensional knitted fabric is preferred. A yarn other than a monofilament may also be optionally subjected to mixed knitting. When mixed knitting is conducted, a yarn other than a monofilament is preferably used for the connecting yarn in a weight mixing ratio of 50% or less, more preferably 40% or less. For example, when the false-twisted yarn of multifilaments is subjected to mixed knitting, a sound, offensive to the ear and generated by friction of the monofilaments against each other during compression of the knitted fabric, can be reduced.

A freely selected material can be used for the monofilament used for the connecting yarn. Examples of the material include poly(trimethylene terephthalate) fiber, poly(butylene terephthalate) fiber, poly(ethylene terephthalate) fiber, polyamide fiber, polypropylene fiber, poly(vinyl chloride) fiber and polyester elastomer fiber. Of these fibers, poly(trimethylene terephthalate) fiber is preferred because use of the fiber gives a knitted fabric having elastic cushioning properties is obtained, and the durability of the cushioning properties after repeated compression or compression for a long period of time becomes excellent.

A bulky yarn such as a multifilament false-twisted yarn and a spun yarn is preferably used at least on one side of the three-dimensional knitted fabric as a yarn used for the front and back double layer knitted fabric in order to increase the covering ratio so that the monofilament of the connecting yarn is not exposed to the knitted fabric surface and the covering ratio is increased. Moreover, use of a composite yarn of side-by-side type, or the like type, is preferred, because the stretchability and recovery of the knitted fabric is further improved.

Although there is no specific limitation on the size of a monofilament used as the connecting yarn, the size is usually from 20 to 2,000 dtex. In order to impart more excellent cushioning properties with an elastic feel to the three-dimensional knitted fabric, the size of the monofilament is preferably from 250 to 700 dtex, more preferably from 280 to 500 dtex.

A density of the connecting yarn is represented by the total cross-sectional area of the connecting yarn within an area of 2.54 cm×2.54 cm (6.45 $cm^2$) of the three-dimensional knitted fabric. The total cross-sectional area is calculated by the formula;

$$N \cdot T/1\times10^6 \cdot \rho_0$$

wherein N is a number of the connecting yarn within an area of 2.54 cm×2.54 cm (6.45 $cm^2$), T ($g/1\times10^6$ cm) is a size in terms of dtex of the connecting yarn, and $\rho_0$ ($g/cm^3$) is a specific gravity of the connecting yarn. In the present invention, the density of the connecting yarn in the three-dimensional knitted fabric is preferably from 0.03 to 0.35 $cm^2$, and more preferably from 0.05 to 0.25 $cm^2$.

Moreover, loop-like knitting stitches may be formed in the front and back side knitted fabrics as the knitting stitch of the connecting yarn. The knitting stitch may also be a structure in which the connecting yarn hooks the front and back side knitted fabrics in an insertion stitch-like manner. Furthermore, in order to improve the shape stability and obtain good cushioning properties of the three-dimensional knitted fabric, it is preferred that at least two connecting yarns be obliquely inclined in the front and back side knitted fabrics mutually in the reverse directions, and connected in a cross-like or truss-like manner.

In order for the three-dimensional knitted fabric to have a soft elastic feel in a stretch placing type seat, the knitted fabric should show a laying spread compression modulus of preferably from 20 to 150 N/mm, more preferably from 25 to 100 N/mm, and most preferably from 25 to 80 N/mm. When the laying spread compression modulus is in the above range, the knitted fabric has a soft elastic feel, and gives no feeling of touching the bottom. The laying spread compression modulus of the three-dimensional knitted fabric is adjusted by factors such as a size of a connecting yarn forming the three-dimensional knitted fabric, a density of the connecting yarn per unit area, an inclination of the connecting yarn, a thickness of the knitted fabric, and a heat set temperature during finish processing. The laying spread compression modulus must be determined while these factors are being fully considered.

The three-dimensional knitted fabric can be knitted with a double raschel knitting machine having two opposite needle beds, a double tubular knitting machine, a flat knitting machine having a V bed, or the like machine. However, in order to obtain a three-dimensional knitted fabric having good dimensional stability, a double raschel knitting machine is preferably used.

Although the thickness of the three-dimensional knitted fabric can be freely determined according to the application, a thickness of from 3 to 30 mm is preferably used. When the thickness is in the above range, the knitted fabric shows a sufficient compression amount, and is excellent in cushioning properties, and is easily finish processed.

A poly(trimethylene terephthalate) yarn preferably used for the sheet material for a seat of the invention is a polyester yarn having a trimethylene terephthalate unit as a principal repeating unit, and contains about 50% by mole or more, preferably 70% by mole or more, more preferably 80% by mole or more, and still more preferably 90% by mole or more of a trimethylene terephthalate unit. Accordingly, the poly (trimethylene terephthalate) yarn contains a poly(trimethylene terephthalate) that contains as a third component another acid component and/or another glycol component in a total amount of about 50% by mole or less, preferably 30% by mole or less, more preferably 20% by mole or less, and still more preferably 10% by mole or less.

The strength of the poly(trimethylene terephthalate) yarn is preferably from 2 to 5 cN/dtex, more preferably from 2.5 to 4.5 cN/dtex, and still more preferably from 3 to 4.5 cN/dtex. Moreover, the elongation is preferably from 30 to 60%, more preferably from 35 to 55%, and still more preferably from 40 to 55%. The modulus is preferably 30 cN/dtex or less, more preferably from 10 to 30 cN/dtex, still more preferably from 12 to 28 cN/dtex, and particularly preferably from 15 to 25 cN/dtex. The elastic recovery at 10% elongation is preferably 70% or more, more preferably 80% or more, still more preferably 90% or more, and most preferably 95% or more.

A poly(trimethylene terephthalate) is synthesized by combining terephthalic acid or its functional derivative and trimethylene glycol or its functional derivative in the presence of a catalyst under suitable reaction conditions. In the course of the synthesis, a suitable third component that is one type or at least two types may be added to form a copolymerized polyester. Moreover, the poly(trimethylene terephthalate) may also be blended with such a polyester other than poly(trimethylene terephthalate) as poly(ethylene terephthalate) and a poly(butylene terephthalate) or nylon. Alternatively, the poly (trimethylene terephthalate) may also be made to form a conjugate yarn (sheath-core type, side-by-side type, and the like type) with the above polyesters or nylon.

Examples of the conjugate yarn are explained below. As exemplified in Japanese Examined Patent Publication (Kokoku) No. 43-19108, Japanese Unexamined Patent Publications (Kokai) Nos. 11-189923, 2000-239927 and 2000-256918, and the like, a poly(trimethylene terephthalate) is used as a first component of the composite spun yarn, and a polyester such as a poly(trimethylene terephthalate), a poly (ethylene terephthalate) and a poly(butylene terephthalate) or nylon is used as a second component thereof; the first component and the second component are composite spun in a side-by-side type manner (spun in parallel) or in an eccentric sheath-core type manner (spun eccentrically). In particular, a combination of a poly(trimethylene terephthalate) and a copolymerized poly(trimethylene terephthalate), or a combination of two types of poly(trimethylene terephthalate) each having an intrinsic viscosity different from the other is preferred. Of these, the following composite spun yarn as exemplified in Japanese Unexamined Patent Publication (Kokai) No. 2000-239927 is particularly preferred because the yarn has high stretchability and bulkiness: two types of poly(trimethylene terephthalate) each having an intrinsic viscosity different from the other are used, and composite spun in a side-by-side manner with the bonded face shape curved so as to enclose the high viscosity side with the low viscosity side.

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodiosulfoisophthalic acid, aliphatic glycols such as ethylene glycol, 1,2-propylene glycol and tetramethylene glycol, alicyclic glycols such as cyclohexanedimethanol, aliphatic glycols including an aromatic group such as 1,4-bis(β-hydroxyethoxy)benzene, polyether glycols such as poly(ethylene glycol) and polypropylene glycol, aliphatic oxycarboxylic acids such as ω-oxycaproic acid, aromatic oxycarboxylic acids such as p-oxybenzoic acid. Moreover, a compound having one or at least three ester-forming functional groups such as benzoic acid or glycerin may also be used as long as the polymer is substantially linear.

Furthermore, the polymer may also contain delustering agents such as titanium dioxide, stabilizers such as phosphoric acid, UV absorbers such as hydroxybenzophenone derivatives, nucleating agents such as talc, lubricating agents such as Aerosil, antioxidants such as hindered phenol derivatives, flame retardants, antistatic agents, pigments, fluorescent brighteners, IR absorbers, defoaming agents, and the like.

Methods of spinning a poly(trimethylene terephthalate) yarn are described in, for example, the pamphlet of International Publication WO 99/27168, and the methods include: a method comprising winding an undrawn yarn at a rate of 1,500 m/min, and drawing and twisting the undrawn yarn by a factor of from 2 to 3.5; a direct drawing method (spin draw method) in which steps of spinning a yarn and drawing the yarn are directly connected; and a high speed spinning method (spin take-up method) in which the winding rate is 5,000 m/min or more. Any of such methods may be adopted.

A monofilament of poly(trimethylene terephthalate) fiber can be produced by a method described in, for example, the pamphlet of International Publication WO 01/75200. That is, the method comprises injecting a poly(trimethylene terephthalate) from a spinning nozzle, rapidly cooling the spun polymer in a cooling bath, winding the monofilament with a first roll, then winding the monofilament with a second roll while the monofilament is being stretched in hot water or in a dry heat atmosphere, relaxation treating the wound monofilament by over feeding in a dry or wet heat atmosphere, and winding the relaxation treated monofilament with a third roll.

For the shape of the yarn, the yarn may be a filaments yarn or a short fiber, or the yarn may be uniform in the longitudinal direction, or the yarn may be thick and thin therein. A circular cross section of the yarn is preferred because the cushioning properties and durability of the three-dimensional knitted fabric are improved.

It is preferred that a raw yarn lubricant be made to stick to a yarn to be used for the sheet material for a seat of the present invention, in order to improve unwindability of the yarn from a cheese, a cone or a pirn, and decrease friction between the yarns, wear between the yarn and the guide of a knitting machine, or the like, and wear between the yarn and a knitting needle of a knitting machine. In order to make the yarn flame-retardant, a sticking amount of the raw yarn lubricant is preferably 2% omf or less. Moreover, because a silicone compound in the raw yarn lubricant is combustible, it is preferred that the raw yarn lubricant contain no silicone compound.

In particular, when the sheet material for a seat of the invention is not subjected to boil-off treatments such as scouring and dyeing, the raw yarn lubricant must be evaporated with only heat energy of heat setting. As a result, when the sticking amount of the raw yarn lubricant is excessive, or when the raw yarn lubricant contains a silicone compound, the flame-retardant effect is lessened sometimes.

Furthermore, a yarn used for the sheet material for a seat may be colored. Examples of the dyeing method include: a method (yarn dyeing) comprising dying an uncolored yarn in a hank or cheese; a method (stock solution dyeing) comprising mixing a stock solution prior to dyeing with a pigment, a dye, etc., and dyeing a yarn with the stock solution; and a method comprising dyeing or printing a yarn in a sheet form. However, when a three-dimensional knitted fabric is dyed or printed, the three-dimensional shape is hardly maintained, and apprehensions about the processability sometimes remain. Stock solution dyeing by yarn dyeing or master batch coloring is therefore preferred.

The sheet material for a seat of the invention can be appropriately used for a seat in which the sitting portion and/or the back portion is prepared by stretching the sheet material on a frame. There is no specific restriction on the state of stretching the sheet material on a frame. The periphery or at least two sides of the sheet material should be stretched on a frame so that the sheet material is in a tense state or in a relaxed state to form the sitting or back portion of the seat.

A freely selected method of fixing the sheet material for a seat to a frame can be employed. For example, as described in Japanese Unexamined Patent Publication (Kokai) No. 2002-219985, the following methods can be optionally used: a method comprising firmly attaching a plate member having an approximately U-shaped cross section with a groove to an end portion of the sheet material, and engaging the groove of the plate member with a suitable frame material; a method comprising connecting trim cloth further to an end portion of the sheet material, firmly attaching the above plate member to the trim cloth, and engaging the plate member with a suitable frame member; a method comprising subjecting an end portion of the three-dimensional knitted fabric to a treatment such as melt sticking, stitching and a resin treatment, pressing the end portion with a presser member, or the like, and fixing the end portion to a frame by bolting, or the like procedure; and a method comprising placing a metal bar in a hollow portion prepared by folding an end portion of the sheet material and stitching the folded back portion, and fixing the metal bar to a frame. Moreover, cushioning properties with a stroke feel can be imparted to the sheet material by fixing the sheet material to a frame through a metal spring such as a coil spring, a torsion bar, or the like.

For the finish texturing methods of the sheet material for a seat, the gray fabric can be finished through steps such as scouring, dyeing and heat setting. However, for a sheet material for a seat for which a yarn-dyed yarn or a stock solution-dyed yarn is used, the scouring and dyeing steps can be omitted, and the gray fabric can also be immediately finished by heat setting alone.

Moreover, during finish setting, the sheet material can be subjected to such finish treatments usually used for fiber treatments as a resin treatment, a water absorption treatment, an antistatic treatment, an antibacterial treatment, a water-repellent treatment and a flame-retardant treatment, as long as the object of the present invention is not impaired.

Examples of a heat treatment machine used for finish setting include a pin tenter, a clip tenter, a short loop drier, a shrink surfer drier, a drum drier and a continuous or batch type tumbler.

The sheet material for seat subsequent to finish treatments can be used for various applications such as a stretch placing type sitting seat and a bed pad by a method of treating the end portions by means such as melt sticking, stitching and a resin treatment and by such a method of processing the sheet material to have a desired shape as heat molding.

Effect of the Invention

The sheet material for a seat of the present invention can be used widely for seats for automobiles, railway vehicles and aircrafts, child seats, baby cars, wheelchairs, furniture, chairs for office use, and the like, by stretching the sheet material on a frame to form a sitting portion and/or a back portion.

Moreover, a seat for which the sheet material for a seat of the invention is used is highly safe, excellent in fitting properties with a human body, and gives a stable and excellent sitting feeling.

BRIEF DESCRIPTION OF THE DRAWINGS

FIG. 2(1) shows a view of the sheet material prior to pressure, and FIG. 2(2) is a view of the sheet material during pressure.

Figure 1:
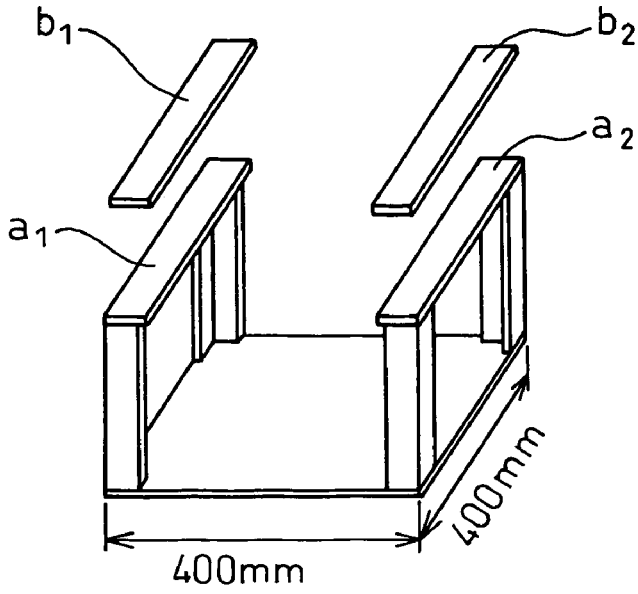
FIG. 1 is a view schematically showing one example of a frame for stretch placing by two opposite side fixing.

DESCRIPTION OF REFERENCE NUMERALS $a_1$—sheet material fixing plate
$a_2$—sheet material fixing plate
$b_1$—sheet presser
$b_2$—sheet presser
$c_1$—sheet presser metal frame
$c_2$—sheet material fixing metal frame
w—compression jig
$H_0$—space between markings prior to reduction in width
$H_1$—space between markings subsequent to reduction in width
s—curve in compressing
k—curve in recovery

BEST MODE FOR CARRYING OUT THE INVENTION

The present invention is further explained below by making reference to examples. However, the present invention is in no way restricted thereto.

A monofilament and a heat melt sticking monofilament of poly(trimethylene terephthalate) fiber used in the examples and comparative examples were produced by the methods shown in reference examples.

In addition, physical properties and other properties were determined by the methods explained below.

(1) Stress at 5% Elongation

A finished three-dimensional knitted fabric is cut to give a test piece, 20 cm (length)×4 cm (width). Five test pieces each 20 cm long in the longitudinal direction (direction along the wale direction), and five test pieces 20 cm long in the lateral direction (direction along the course direction) are sampled.

A tensile stress at 5% elongation of a test piece is determined with a Shimadzu autograph AG-B type (manufactured by SHIMADZU SEISAKUSHO) under the following conditions: a chuck width of 4 cm; a chuck-to-chuck distance of 10 cm; a tensile speed of 50 mm/min; and an initial load of from 2 to 3 N/4 cm. Measurements are made on the above 5 test pieces 20 cm long in the longitudinal direction, and the average value is defined as a tensile stress at 5% elongation in the longitudinal direction. Measurements are made on the above 5 test pieces 20 cm long in the lateral direction, and the average value is defined as a tensile stress at 5% elongation in the lateral direction. The direction in which the stress at 5% elongation is high in comparison with the other direction is defined as the A direction.

(2) Reduction in Width (H) during Stretch Placing with Two Sides Fixed

The feet of equal angles 250 mm high are welded to the four corners of a metal base plate, 400 mm×400 mm (4 mm in thickness) as shown in FIG. 1; two metal plates each being 5 mm thick, 400 mm long and 55 mm wide are welded onto the feet so that the two plates become parallel to the two opposite sides, respectively, of the metal base plate to give a frame for stretch placing having two side sheet material fixing plates $a_1$, $a_2$. A #40 sandpaper is stuck to the front faces of the two opposite side fixing plates $a_1$, $a_2$ with a double-coated tape to impart anti-slipping properties. On the other hand, a #40 sand paper is stuck to the back faces of two metal plates each being 5 mm thick, 400 mm long and 55 mm wide with a double-coated film to give sheet pressers $b_1$, $b_2$ to which anti-slipping properties are imparted A sheet material for a seat, 400 mm×400 mm, prepared by cutting is sandwiched between a pair of a sheet material fixing plate and a sheet presser at one end of the sheet material and between a pair of a sheet material fixing plate and a sheet presser at the other end thereof so that the sheet material is not relaxed, and stretch placed by fixing with vises at six sites in total. During stretch placing, both ends in the A direction obtained by determining the stress at 5% elongation in (1) explained above are fixed on the two sides. In advance, a marking line 50 mm apart from one of the two ends that are not fixed is drawn on the sheet material surface, and a marking line 50 mm apart from the other one thereof is also drawn (that is, the space ($H_0$) between the two marking lines prior to reduction in width is 300 mm).

Figure 2:
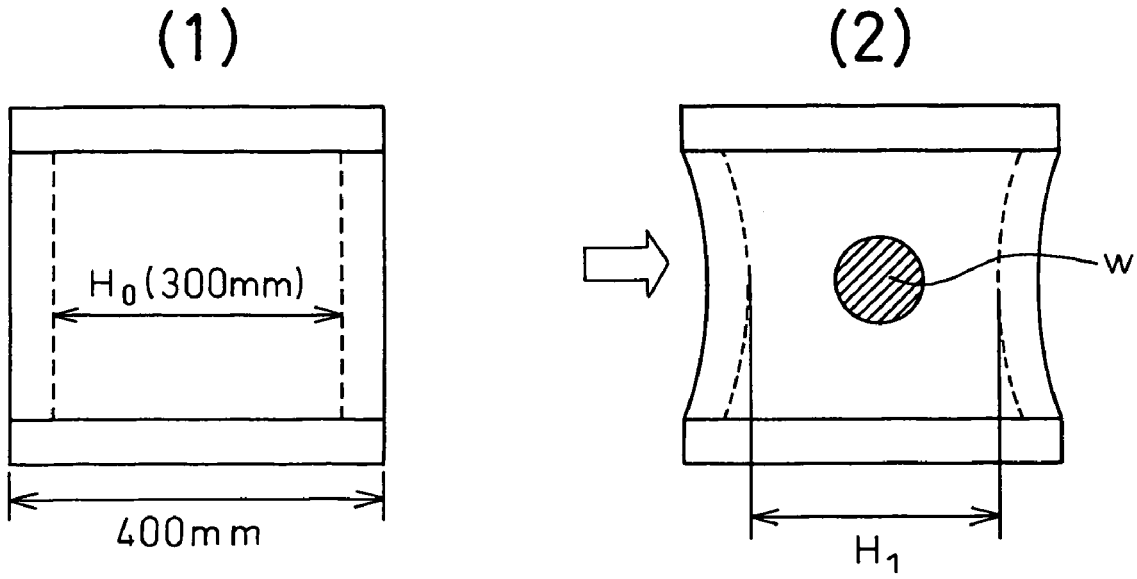
FIG. 2 is views observed from the upside of a state in which a sheet material is stretch placed by two opposite side fixing, and is an explanatory view schematically showing the measurement of a reduction in width (H) when the sheet material is fixed on a frame at the one end and the opposite end while stretched and pressured.

Using a Shimadzu autograph AG-B type (manufactured by SHIMADZU SEISAKUSHO), the central portion of the stretch placed front side of knitted fabric is compressed with a disk-like compressive jig 100 mm in diameter at a speed of 50 mm/min. When the load reaches 245 N, the load is held for 15 sec. The space (H1) between the marking lines after reduction in width shown in FIG. 2 is then measured, and the reduction in width (H) is calculated from the following formula:

$$H(\%)=[(H_0-H_1)/300]\times 100$$

(3) Stretch Placing Compression Penetration Strength (G)

The central portion of a sheet material for a seat, 40 cm×40 cm, prepared by cutting is punched with a blanking punch in advance, to have a circular hole 1.5 cm in diameter, to give a sample; three samples are prepared. One of the samples is sandwiched between a pair of a sheet material fixing plate and a sheet presser at one end of the sheet material and between a pair of a sheet material fixing plate and a sheet presser at the other end thereof in the frame for stretch placing of two opposite side fixing type (FIG. 1) so that the sheet material is not relaxed, and stretch placed by fixing with vises at six sites in total (three sites on each side). In addition, both ends in the A direction obtained by determining the stress at 5% elongation in (1) explained above are fixed on the two sides.

Using a Shimadzu autograph AG-B type (manufactured by SHIMADZU SEISAKUSHO), a load is applied to the central portion (a hole 1.5 cm in diameter) of the stretch placed sheet material for a seat with a metal semispherical compressive jig 100 mm in diameter at a speed of 50 mm/min until the jig penetrates the sample. A maximum load during compression penetration is measured three times, and the average value is defined as a stretch placing compression penetration strength (G) (the stress figures less than tens being neglected).

Figure 3:
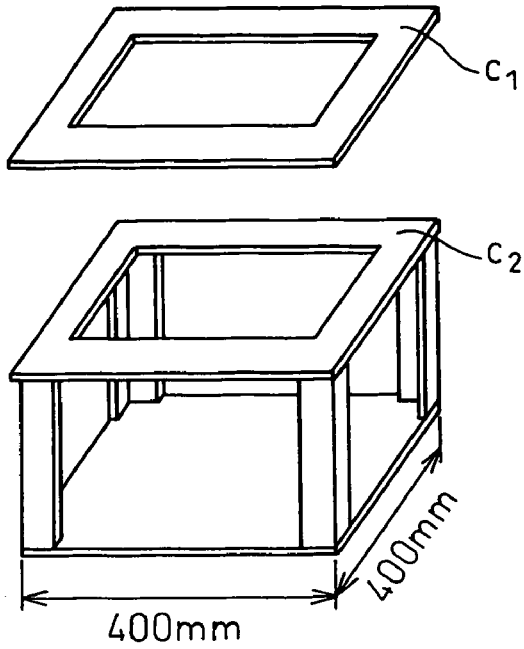
FIG. 3 is a view schematically showing one example of a frame for stretch placing by four side fixing.

(4) Surface Elongation (F) of a Front Side Knitted Fabric and Surface Elongation (D) of a Back Side Knitted Fabric A frame for stretch placing by four side fixing as shown in FIG. 3 is prepared by the following procedure.

The legs of steel angle bars having 250 mm high are welded to the four corners of a metal base plate, 400 mm×400 mm (5 mm in thickness), and a metal frame $c_2$, 410 mm×410 mm (5 mm in thickness), having an internally cut-out square space, 300 mm×300 mm, and a width 55 mm wide is welded onto the feet to give a frame for stretch placing. A #40 sand paper is stuck to the upper face of the metal frame $c_2$ with a double-coated tape to impart anti-slipping properties. On the other hand, a #40 sand paper is stuck to the lower face of a metal frame $c_1$, 410 mm×410 mm (5 mm in thickness), having an internally cut-out square space, 300 mm×300 mm, and a width 55 mm wide so that anti-slipping properties are imparted to give a presser of a knitted fabric.

The approximately central portion of a connecting yarn of a finished three-dimensional knitted fabric, 400 mm×400 mm is cut to give a front side knitted fabric and a back side knitted fabric separately. Three front side knitted fabrics and three back side knitted fabrics are prepared by the above procedure. The front side knitted fabric or back side knitted fabric of a three-dimensional knitted fabric is sandwiched between the sheet material fixing frame (metal frame $c_2$) of the stretch placing frame of four side fixing type and the sheet presser frame (metal frame $c_1$) so that the knitted fabric is not relaxed with the connecting yarn side placed down side, and the periphery of the knitted fabric is fixed with vises.

Using a Shimadzu autograph AG-B type (manufactured by SHIMADZU SEISAKUSHO), the central portion of the stretch placed front side knitted fabric is compressed with a disk-like compressive jig 100 mm in diameter at a speed of 50 mm/min. A displacement under a load of 245 N is measured and defined as a compressive deflection (M) (mm).

The surface elongation (F) of the front side knitted fabric and the surface elongation (D) of the back side knitted fabric are obtained from the following formula:

$$F(\%)=\{(150^2+M^2)^{0.5}-150\}\times 100/150$$

$$D(\%)=\{(150^2+M^2)^{0.5}-150\}\times 100/150$$

Measurements are made three times, and the average value is defined as F or D.

(5) Compression Modulus (E)

Figure 4:
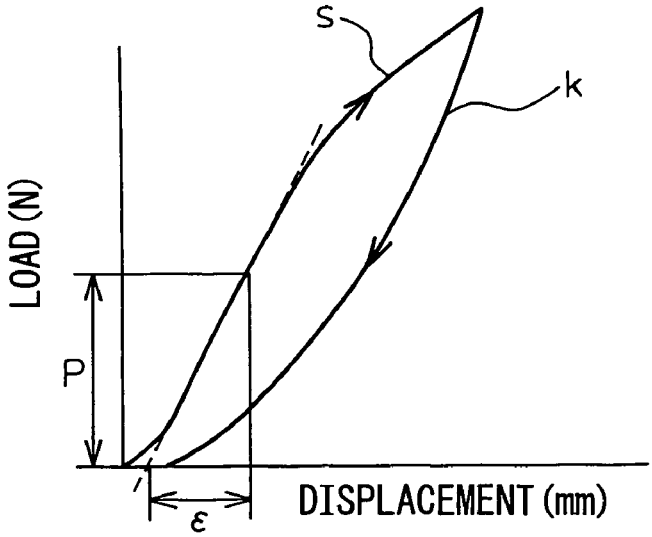
FIG. 4 is a graph showing one example of a load-displacement curve during compression obtained by measurement of a compression modulus (E).

Using a Shimadzu autograph AG-B type (manufactured by SHIMADZU SEISAKUSHO), a three-dimensional knitted fabric, 40 cm×40 cm, placed on a rigid body surface is compressed with a disk-like compressive jig 100 mm in diameter at a speed of 10 mm/min while a point at which the load is 1 N is taken as the 0 point. When the load reaches 245 N, the compression is immediately released at a speed of 10 mm/min. As a result, a load-displacement curve (curve in compression: s, curve in recovery: k) is obtained as shown in, for example, FIG. 4.

A tangential line drawn in an approximately linear region of the rise portion of the curve in compression s in the load-displacement curve thus obtained. The slope of the tangential line is calculated from the formula {load P (N)/displacement ϵ (mm)}, and defined as a compression modulus E (N/mm).

(6) Dry Heat Shrinkage of a Yarn Used for a Ground Structure

The dry heat shrinkage of a yarn is determined in accordance with dry heat shrinkage test method (B method) according to JIS L 1013. The drying machine temperature is set at 150° C. during the test.

(7) Evaluation of Wrinkles in a Three-Dimensional Knitted Fabric

The appearance of a finished three-dimensional knitted fabric, 40 cm×40 cm, is observed, and a comparative evaluation is made according to the following four ranks. The evaluation is made on both the front side and the back side.

◎: No wrinkles are observed.

○: Although thin streak-like traces are observed, the traces are not wrinkles.

Δ: The knitted fabric has an uneven feel, and the fabric has wrinkles with shallow recessed portions.

X: The depth of a recessed portion has at least a half of the thickness of the fabric, and the fabric has deep wrinkles.

(8) Sitting Feeling (Fitting Properties, Unpleasant Feeling Caused by Reduction in Width, Stable Feeling) at a Stretch Placed Seat and Elongation Recovery A seat frame (without a backrest) in which the sitting portion has a dimension of 52 cm in width, 47 cm in depth and 32 cm in height and which is formed out of a metal square pipe is prepared.

Two approximately U-shaped plates made of a poly(butylene terephthalate) resin are attached by stitching to the entire width of two sides, respectively, at both ends in the longitudinal direction of a sheet material for a seat, 50 cm (width)×57 cm (length)(the A direction obtained by determining a stress at 5% elongation in (1) explained above is taken as the longitudinal direction). One of the resin-made U-shaped plates of the sheet material for a seat is engaged with a metal-made approximately U-shaped plate attached below the front edge of the seat frame. The sheet material for a seat is stretched from the front to the back of the seat frame while a load of 10 kg is being applied to the entire width of the sheet material for a seat to impart a tension to the sheet material. A metal-made U-shaped plate attached below the back edge of the seat frame is engaged with the resin-made U-shaped plate of the sheet material for a seat to stretch place the sheet material in a tensed state. In addition, when the tension of 10 kg shifts the relative positions of the metal-made U-shaped plates and the resin-made U-shaped plates, the relative positions are adjusted by shifting the sites where the metal-made U-shaped plates and the resin-made U-shaped plates are bolted.

A male panelist having a bodyweight of 65 kg sat on the seat for 10 minutes while the direction of his knees are made to conform to the longitudinal direction of the sheet material for a seat, and then he left the seat.

The flexibility and fitting properties of the sheet material for a seat is comparatively evaluated according to the following four ranks as the evaluation of a sitting feeling during sitting of the sheet material.

◎: The sheet material has a suitable flexibility, and is excellent in fitting properties.

○: The sheet material has a slightly high or slightly low (hard) flexibility, and is excellent in fitting properties.

Δ: The sheet material has a considerably high or considerably low (hard) flexibility, and is poor in fitting properties.

X: The sheet material has an excessively high or excessively low (hard) flexibility, and is poor in fitting properties.

Moreover, an unpleasant feeling (the panelist's sense that he sits on a foreign matter due to an upthrust of the knitted fabric in the gap between the buttocks) during sitting is comparatively evaluated according to the following four ranks by sensory evaluation.

◎: The panelist has no unpleasant feeling.

○: The panelist has substantially no unpleasant feeling.

Δ: The panelist has a slightly unpleasant feeling.

X: The panelist has a markedly unpleasant feeling.

Furthermore, a stable feeling the panelist has during sitting is comparatively evaluated according to the following four ranks.

◎: The sheet material has a suitable surface stiffness, and gives the panelist an excellent stable feeling.

○: The sheet material has a slightly high surface stiffness, and gives the panelist a stable feeling.

Δ: The sheet material has a slightly low surface stiffness, and gives the panelist a slightly poor stable feeling.

X: The sheet material has a low surface stiffness, and gives the panelist a poor stable feeling.

Furthermore, the recovery state of the fabric spring after panelist's leaving the sheet material is visually observed, and a comparative evaluation is according to the following four ranks.

◎: The fabric spring is completely recovered.

○: The fabric spring is substantially recovered.

Δ: A slightly recessed portion (deformation) remains.

X: A large recessed portion remains.

REFERENCE EXAMPLE 1

<Production of a Monofilament of Poly(trimethylene terephthalate) Fiber>

A poly(trimethylene terephthalate) monofilament to be used in examples was produced by the following procedure.

A poly(trimethylene terephthalate) having an intrinsic viscosity [η] of 0.9 was injected at a spinning temperature of 265° C. from a spinning nozzle. The injected polymer was introduced into a cooling bath at 40° C., and pulled with a first roll group at a speed of 16.0 m/min while being cooled in the bath, to be thinned and give an undrawn monofilament. The undrawn monofilament was pulled in a drawing bath at 55° C. with a second roll group at a speed of 80.0 m/min while being stretched by a factor of 5. The drawn monofilament was then passed through a third roll group at a speed of 72.0 m/min while being relaxation heat treated in a steam bath at 120° C., and wound on a winder rotating at the same speed as that of the third roll group to give a drawn monofilament of 390 dtex.

A drawn monofilament having a size of 880 dtex was produced in the same manner as explained above.

The resultant drawn monofilament having a size of 390 dtex showed the following physical properties: a strength of 2.7 cN/dtex; an elongation of 49%; a modulus of 27 cN/dtex; and an elastic recovery at 10% elongation of 98%. The resultant drawn monofilament having a size of 880 dtex showed the following physical properties: a strength of 2.6 cN/dtex; an elongation of 51%; a modulus of 27 cN/dtex; and an elastic recovery at 10% elongation of 98%.

The intrinsic viscosity [η] (dl/g) is a value obtained from the following formula:

$$[\eta]=\lim_{C\to 0}(\eta_r-1)/C$$

wherein $\eta_r$ (that is defined as a relative viscosity) is a value obtained by dividing a viscosity of a diluted solution at 35° C. of a poly(trimethylene terephthalate) yarn or a poly(ethylene terephthalate) yarn dissolved in an o-chlorophenol solvent having a purity of 98% or more by the viscosity of the above solvent determined at the same temperature, and C is a polymer concentration in terms of g/100 ml of the above solution.

REFERENCE EXAMPLE 2

<Production of a Heat Melt Sticking Monofilament>

Heat melt sticking monofilaments used in examples were prepared by the following procedure.

Dimethyl terephthalate and ethylene glycol were charged into a reaction vessel, and a small amount of a catalyst was added to the contents. The reaction mixture was subjected to a transesterification reaction by a conventional method to give an oligomer. On the other hand, adipic acid and ethylene glycol were charged into a reaction vessel, and a small amount of catalyst was added to the contents. The reaction mixture was subjected to a transesterification reaction by a conventional method to give an oligomer.

The oligomers thus obtained and a small amount of an antioxidant were mixed, and the mixture was successively subjected to a polycondensation reaction to give a copolymerized polyester having a melting point of 120° C., a glass transition point of 0° C. and a density of 1.25 g/cm$^3$. The copolymerized polyester thus obtained was used as a sheath component, and a poly(trimethylene terephthalate) having an intrinsic viscosity [η] of 0.92, a melting point of 227° C. and a density of 1.35 g/cm$^3$ was used as a core component; a sheath-core monofilament was produced under the following conditions.

Injection amount of the sheath component: 2.4 g/min
Melting point of the sheath component: 200° C.
Injection amount of the core component: 4.9 g/min
Melting point of the core component polymer: 260° C.
Spinning temperature: 260° C.
Cooling bath water temperature: 40° C.
Peripheral speed of a take-up roll (first roll): 8.8 m/min
Drawing bath water temperature: 55° C.
Peripheral speed of a drawing roll (second roll): 44 m/min
Dry heat heater temperature: 140° C.
Peripheral speed of a third roll: 40 m/min
Winding speed: 40 m/min The following three types of sheath-core monofilaments were produced under the above production conditions: a sheath-core monofilament having a circular cross section, an area ratio of the core portion of 63%, a size of 1,060 dtex, a breaking strength of 2.3 cN/dtex and a breaking elongation of 53%; a sheath-core monofilament having an area ratio of the core portion of 65%, a size of 1,820 dtex, a breaking strength of 2.2 cN/dtex and a breaking elongation of 50%; and a sheath-core monofilament having an area ratio of the core portion of 65%, a size of 3,230 dtex, a breaking strength of 2.2 cN/dtex and a breaking elongation of 50%. The sheath components had a melting point of 121° C. and a glass transition temperature of 0° C.

In addition, the intrinsic viscosity [η] was measured by the method mentioned above.

EXAMPLE 1

Using a double raschel knitting machine of 14 gauge equipped with 6 guide bars and having a needle cylinder space of 13 mm, false-twisted yarns of poly(ethylene terephthalate) fiber having a size of 500 dtex/144 filaments and showing a dry heat shrinkage of 3.3% were fed in an all-in arrangement from guide bars (L1, L2) for forming a front side knitted fabric. A monofilament of poly(trimethylene terephthalate) fiber having a size of 390 dtex and having been produced in Reference Example 1 was then fed in an all-in arrangement from a guide bar (L3) for forming a connecting portion. Moreover, false-twisted yarns of poly(ethylene terephthalate) fiber having a size of 500 dtex/144 filaments and showing a dry heat shrinkage of 5.7% were fed in an all-in arrangement from guide bars (L4, L5) for forming a back side knitted fabric.

An insertion yarn (a monofilament of poly(trimethylene terephthalate) fiber having a size of 880 dtex and having been produced in Reference Example 1) was inserted with the knitting stitch shown below, in an all-in arrangement into the back side knitted fabric in the longitudinal direction from a guide bar (L6) at a picking density of 12.7 courses/2.54 cm to give a gray fabric of a three-dimensional knitted fabric. The gray fabric thus obtained was tendered by 1%, and dry heat set at 150° C. for 3 minutes to give a three-dimensional knitted fabric having flat front and back side fabrics.

Table 1 shows physical properties of the three-dimensional knitted fabric thus obtained.

(Knitting Stitch)
L1: 1211/1011/(all-in)
L2: 0111/2111/(all-in)
L3: 3410/4367/(all-in)
L4: 1110/0001/(all-in)
L5: 5510/1156/(all-in)
L6: 2222/0000/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 2

The procedure of Example 1 was repeated except that raw yarns of poly(ethylene terephthalate) fiber each having a size of 500 dtex/144 filaments and showing a dry heat shrinkage of 13.8% were fed from guide bars (L4, L5) for forming the back side knitted fabric, and that an insertion yarn prepared by doubling two monofilaments of poly(trimethylene terephthalate) fiber having a size of 390 dtex and having been produced in Reference Example 1 was inserted in the longitudinal direction from a guide bar (L6) to give a three-dimensional knitted fabric. Table 1 shows physical properties of the three-dimensional knitted fabric thus obtained.

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 3

The procedure of Example 2 was repeated except that the knitting stitch was varied as shown below to give a three-dimensional knitted fabric. Table 1 shows physical properties of the three-dimensional knitted fabric thus obtained.

(Knitting Stitch)

L1: 1211/1011/(all-in)

L2: 0111/2111/(all-in)

L3: 3410/4367/(all-in)

L4: 1110/0001/(all-in)

L5: 7710/1178/(all-in)

L6: 2222/0000/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 4

The procedure of Example 2 was repeated except that yarns each prepared by doubling two yarns were fed so that the arrangement of the guide bar (L1) for forming the front side knitted fabric became 2-in×2-out, that yarns were similarly fed so that the arrangement of the guide bar (L2) became 2-out×2-in and that the knitting stitch was varied as shown below to give a surface mesh-like three-dimensional knitted fabric. Table 1 shows physical properties of the three-dimensional knitted fabric thus obtained.

(Knitting Stitch)

L1: 0111/3233/4544/3222/(2-in×2-out)

L2: 4544/3222/0111/3233/(2-out×2-in)

L3: 3410/4367/(all-in)

L4: 1110/0001/(all-in)

L5: 7710/1178/(all-in)

L6: 2222/0000/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 5

The procedure of Example 4 was repeated except that false-twisted yarns of flame-retardant poly(ethylene terephthalate) fiber (each being an interlacing textured yarn prepared by doubling three yarns (trade name of HEIM, manufactured by Toyobo Co., Ltd.) each having a size of 167 dtex/48 filaments) each having a size of 500 dtex/144 filaments and showing a dry heat shrinkage of 5.3% were fed from guide bars (L1, L2, L4, L5) for forming the front and back side knitted fabrics to give a three-dimensional knitted fabric. Table 1 shows physical properties of the three-dimensional knitted fabric thus obtained.

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 6

Using a double raschel knitting machine of 14 gauge equipped with a weft yarn inserting apparatus and having 10 guide bars and a needle cylinder space of 12 mm, yarn-dyed false-twisted yarns of poly(ethylene terephthalate) fiber (each being an interlacing textured yarn prepared by doubling three yarns each having a size of 167 dtex/30 filaments; colored black) each having a size of 500 dtex/90 filaments and showing a dry heat shrinkage of 1.8% were fed in an all-in arrangement from guide bars (L3, L4) for forming a front side knitted fabric. A monofilament of poly(trimethylene terephthalate) fiber having a size of 390 dtex and having been produced in Reference Example 1 was then fed in an all-in arrangement from a guide bar (L5) for forming a connecting portion. Moreover, yarn-dyed false-twisted yarns of poly(ethylene terephthalate) fiber (each being an interlacing textured yarn prepared by doubling three yarns each having a size of 167 dtex/30 filaments; colored black) having a size of 500 dtex/90 filaments and showing a dry heat shrinkage of 1.8% were fed in an all-in arrangement from guide bars (L7, L8) for forming a back side knitted fabric.

With the knitting stitch shown below, a doubled and twisted yarn of poly(trimethylene terephthalate) fiber (a yarn prepared by ring twisting 8 yarns each having a size of 167 dtex/48 filaments under the condition of Z-twisting at 125 T/m) having a size of 1,336 dtex/384 filaments was weft inserted into each course of the back side knitted fabric at a picking density of 12.0 courses/2.54 cm to give a gray fabric of a three-dimensional knitted fabric. The gray fabric thus obtained was tentered by 1%, and dry heat set at 170° C. for 3 minutes to give a three-dimensional knitted fabric having flat front and back side knitted fabrics.

Table 1 shows physical properties of the three-dimensional knitted fabric thus obtained.

(Knitting Stitch)

L3: 1211/1011/(all-in)

L4: 0111/2111/(all-in)

L5: 3410/4367/(all-in)

L7: 1110/0001/(all-in)

L8: 3310/1134/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 7

The procedure of Example 6 was repeated except that yarns each prepared by doubling two yarns were fed so that the arrangement of the guide bar (L3) for forming the front side knitted fabric became 2-in×2-out, that yarns were similarly fed so that the arrangement of the guide bar (L4) became 2-out×2-in, that raw yarns of poly(ethylene terephthalate) fiber each having a size of 500 dtex/144 filaments and showing a dry heat shrinkage of 13.8% were fed from guide bars (L7, L8) for forming the back side knitting stitch, that a doubled and twisted yarn of poly(trimethylene terephthalate) fiber (prepared by ring twisting 12 yarns each having a size of 167 dtex/48 filaments under the condition of Z-twisting at 125 T/m) having a size of 2,016 dtex/576 filaments was inserted as a weft yarn insertion yarn and that the knitting stitch was varied as shown below to give a surface mesh-like three-dimensional knitted fabric.

Table 1 shows physical properties of the three-dimensional knitted fabric thus obtained.

(Knitting Stitch)

L3: 0111/3233/4544/3222/(2-in×2-out)

L4: 4544/3222/0111/3233/(2-out×2-in)

L5: 3410/4367/(all-in)

L7: 1110/0001/(all-in)

L8: 6610/1167/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 8

Using a double raschel knitting machine of 14 gauge equipped with 6 guide bars and having a needle cylinder space of 8 mm, false-twisted yarns of poly(ethylene terephthalate) fiber each having a size of 500 dtex/144 filaments and showing a dry heat shrinkage of 3.3% were fed in an all-in arrangement from guide bars (L1, L2) for forming a front side knitted fabric. A monofilament of poly(trimethylene terephthalate) fiber having a size of 390 dtex and having been produced in Reference Example 1 was then fed in an all-in arrangement from a guide bar (L3) for forming a connecting portion. Moreover, raw yarns for clothing of poly(ethylene terephthalate) fiber (each prepared by doubling two yarns each having a size of 280 dtex/48 filaments) each having a size of 560 dtex/96 filaments and showing a dry heat shrinkage of 11.7% were fed in an all-in arrangement from guide bars (L4, L5) for forming a back side knitted fabric.

An insertion yarn (prepared by doubling two monofilaments of poly(trimethylene terephthalate) fiber each having a size of 390 dtex and having been produced as in Reference Example 1) was inserted with the knitting stitch shown below, in an all-in arrangement into the back side knitted fabric in the longitudinal direction from a guide bar (L6) at a picking density of 13.2 courses/2.54 cm to give a gray fabric of a three-dimensional knitted fabric. The gray fabric thus obtained was tentered by 1%, and dry heat set at 160° C. for 3 minutes to give a three-dimensional knitted fabric having flat front and back side fabrics.

Table 1 shows physical properties of the three-dimensional knitted fabric thus obtained.

(Knitting Stitch)

L1: 1211/1011/(all-in)

L2: 0111/2111/(all-in)

L3: 3410/4367/(all-in)

L4: 1110/0001/(all-in)

L5: 5510/1156/(all-in)

L6: 2222/0000/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 9

Using a double raschel knitting machine of 14 gauge equipped with 6 guide bars and having a needle cylinder space of 13 mm, a false-twisted yarn of poly(ethylene terephthalate) fiber having a size of 500 dtex/144 filaments and showing a dry heat shrinkage of 3.3% was fed in an all-in arrangement from a guide bar (L1) for forming a front side knitted fabric. A raw yarn for clothing of poly(ethylene terephthalate) fiber (prepared by doubling two yarns each having a size of 280 dtex/48 filaments) having a size of 560 dtex/96 filaments and showing a dry heat shrinkage of 11.7% was then fed in an all-in arrangement from a guide bar (L2), and a monofilament of poly(trimethylene terephthalate) fiber having a size of 390 dtex and having been produced in Reference Example 1 was fed in an all-in arrangement from a guide bar (L3) for forming a connecting portion. Moreover, false-twisted yarns of poly(ethylene terephthalate) fiber each having a size of 500 dtex/144 filaments and showing a dry heat shrinkage of 3.3% were fed in an all-in arrangement from guide bars (L4, L6) for forming a back side knitted fabric.

An insertion yarn (prepared by doubling two monofilaments of poly(trimethylene terephthalate) fiber each having a size of 390 dtex and having been produced in Reference Example 1) was inserted with the knitting stitch shown below, in an all-in arrangement into the back side knitted fabric in the longitudinal direction from a guide bar (L5) at a picking density of 11.2 courses/2.54 cm to give a gray fabric of a three-dimensional knitted fabric. The gray fabric thus obtained was tentered by 1%, and dry heat set at 160° C. for 3 minutes to give a three-dimensional knitted fabric having flat front and back side fabrics.

Table 2 shows physical properties of the three-dimensional knitted fabric thus obtained.

(Knitting Stitch)

L1: 5655/1011/(all-in)

L2: 0111/1000/(all-in)

L3: 3410/4367/(all-in)

L4: 1110/0001/(all-in)

L5: 0022/2200/(all-in)

L6: 5510/1156/(all-in)

The three-dimensional knitted fabric thus obtained showed a high stretch placing compression penetration strength, was excellent in suitable fitting properties and flexibility, and gave no unpleasant feeling (caused by reduction in width) about the buttocks and had a stable sitting feeling. Moreover, the knitted fabric was excellent in cushioning properties and recovery after sitting, showed neither prominent recessed portions nor conspicuous lateral wrinkles, and had a good appearance.

EXAMPLE 10

The procedure of Example 9 was repeated except that a raw yarn for clothing of poly(ethylene terephthalate) fiber (prepared by doubling two yarns each having a size of 280 dtex/48 filaments) having a size of 560 dtex/96 filaments and showing a dry heat shrinkage of 11.7% was fed in an all-in arrangement from a guide bar (L1), and that the knitting stitch was varied to L1: 6744/1033/(all-in) to give a three-dimensional knitted fabric. Table 2 shows physical properties of the three-dimensional knitted fabric thus obtained.

The three-dimensional knitted fabric thus obtained showed a high stretch placing compression penetration strength, was excellent in suitable fitting properties and flexibility, and gave no unpleasant feeling (caused by reduction in width) about the buttocks and a stable sitting feeling. Moreover, the knitted fabric was excellent in cushioning properties and recovery after sitting, showed neither prominent recessed portions nor conspicuous lateral wrinkles, and had a good appearance.

COMPARATIVE EXAMPLE 1

The procedure of Example 1 was repeated except that the insertion yarn inserted into the back side knitted fabric in the longitudinal direction was not used, and that the gray fabric was tentered by 15% during finishing the gray fabric to give a three-dimensional knitted fabric. Table 2 shows physical properties of the three-dimensional knitted fabric thus obtained.

Although the three-dimensional knitted fabric thus obtained showed a good stretch placing compression penetration strength, the knitted fabric gave an uncomfortable sitting feeling because the knitted fabric gave an unpleasant feeling in the buttocks. Moreover, the knitted fabric was poor in cushioning properties and fitting properties, and showed a poor recovery with recessed portions remaining after sitting.

COMPARATIVE EXAMPLE 2

The procedure of Example 6 was repeated except that false-twisted yarns of poly(ethylene terephthalate) fiber each having a size of 500 dtex/144 filaments and showing a dry heat shrinkage of 3.3% were fed from guide bars (L3, L4) for forming the front side knitted fabric, that false-twisted yarns of poly(ethylene terephthalate) fiber each having a size of 500 dtex/144 filaments and showing a dry heat shrinkage of 5.7% were fed from guide bars (L7, L8) for forming the back side knitted fabric, and that a poly(trimethylene terephthalate) yarn having a size of 167 dtex/48 filaments was weft yarn inserted into each course of the back side knitted fabric to give a three-dimensional knitted fabric. Table 2 shows physical properties of the three-dimensional knitted fabric thus obtained.

Although the three-dimensional knitted fabric thus obtained showed a good stretch placing compression penetration strength, the knitted fabric gave an unpleasant feeling in the buttocks due to reduction in width, and as a result it gave an uncomfortable sitting feeling. Moreover, the knitted fabric was poor in cushioning properties and fitting properties, and showed a poor recovery with recessed portions remaining after sitting.

COMPARATIVE EXAMPLE 3

The procedure of Example 1 was repeated except that the insertion yarn inserted into the back side knitted fabric in the longitudinal direction was not used, and that the knitting stitch was varied as shown below to give a three-dimensional knitted fabric. Table 2 shows physical properties of the three-dimensional knitted fabric thus obtained.

(Knitting Stitch)

L1: 1211/1011/(all-in)

L2: 0111/2111/(all-in)

L3: 3410/4367/(all-in)

L4: 1110/0001/(all-in)

L5: 3310/1134/(all-in)

Although the three-dimensional knitted fabric thus obtained showed a good stretch placing compression penetration strength, the knitted fabric gave an uncomfortable sitting feeling in the buttocks due to reduction in width. Moreover, the knitted fabric was poor in cushioning properties and fitting properties, and showed a poor recovery with recessed portions remaining after sitting.

COMPARATIVE EXAMPLE 4

The procedure of Example 6 was repeated except that false-twisted yarns of poly(ethylene terephthalate) fiber each having a size of 500 dtex/144 filaments and showing a dry heat shrinkage of 3.3% were fed from guide bars (L3, L4) for forming the front side knitted fabric, that raw yarns of poly (ethylene terephthalate) fiber each having a size of 500 dtex/144 filaments and showing a dry heat shrinkage of 13.8% were fed from guide bars (L7, L8) for forming the back side knitted fabric, and that a doubled and twisted yarn of poly (ethylene terephthalate) fiber (prepared by ring twisting 12 yarns each having a size of 167 dtex/48 filaments under the condition of Z-twisting at 125 T/m) having a size of 2,016 dtex/576 filaments was weft yarn inserted into each course of the back side knitted fabric with the knitting stitch shown below to give a three-dimensional knitted fabric. Table 2 shows physical properties of the three-dimensional knitted fabric thus obtained.

(Knitting Stitch)

L3: 2322/1011/(all-in)

L4: 0111/3222/(all-in)

L5: 3410/4367/(all-in)

L7: 1110/0001/(all-in)

L8: 6610/1167/(all-in)

The three-dimensional knitted fabric thus obtained was poor in cushioning properties and fitting properties, made the panelist feel a pain due to a hard surface although a reduction in width, during the panelist's sitting, was small, and gave an uncomfortable feeling.

COMPARATIVE EXAMPLE 5

The procedure of Comparative Example 4 was repeated except that false-twisted yarns of poly(ethylene terephthalate) fiber each having a size of 500 dtex/144 filaments and showing a dry heat shrinkage of 3.3% were fed from guide bars (L7, L8) for forming the back side knitted fabric to give a three-dimensional knitted fabric. Table 2 shows physical properties of the three-dimensional knitted fabric thus obtained.

The three-dimensional knitted fabric thus obtained was poor in cushioning properties and fitting properties, made the panelist feel a pain due to a hard surface although a reduction in width, during panelist's sitting, was small, and gave an uncomfortable feeling.

COMPARATIVE EXAMPLE 6

Using a double raschel knitting machine of 14 gauge equipped with a weft yarn inserting machine and 10 guide bars and having a needle cylinder space of 12 mm, false-twisted yarns of poly(ethylene terephthalate) fiber each having a size of 500 dtex/144 filaments and showing a dry heat shrinkage of 3.3% were fed in an all-in arrangement from guide bars (L3, L4, L6, L7) for forming front and back side knitted fabrics. A monofilament of poly(trimethylene terephthalate) fiber having a size of 390 dtex and having been produced in Reference Example 1 was then fed in an all-in arrangement from a guide bar (L5) for forming a connecting portion.

With the knitting stitch shown below, an insertion yarn (a monofilament of poly(trimethylene terephthalate) fiber having a size of 880 dtex and having been produced as in Reference Example 1) was inserted in an all-in arrangement from a guide bar (L8) into the back side knitted fabric in the longitudinal direction. Moreover, a doubled and twisted yarn of poly(trimethylene terephthalate) fiber (prepared by ring twisting five yarns each having a size of 167 dtex/48 filaments were under the condition of Z-twisting at 125 T/m) having a size of 835 dtex/240 filaments was weft yarn inserted into each course of the front side knitted fabric at a picking density of 12.0 courses/2.54 cm to give a gray fabric of a three-dimensional knitted fabric. The gray fabric thus obtained was tentered by 1%, and dry heat set at 170° C. for 3 minutes to give a three-dimensional knitted fabric having flat front and back side knitted fabrics.

Table 2 shows physical properties of the three-dimensional knitted fabric thus obtained.

(Knitting Stitch)

L3: 5655/1011/(all-in)

L4: 0111/1000/(all-in)

L5: 3410/4367/(all-in)

L6: 1110/0001/(all-in)

L7: 5510/1156/(all-in)

L8: 2222/0000/(all-in)

The three-dimensional knitted fabric thus obtained was poor in cushioning properties and fitting properties, made the panelist feel a pain to a certain degree due to a hard surface although a reduction in width, during panelist's sitting, was small, and gave an uncomfortable feeling.

COMPARATIVE EXAMPLE 7

Using a double raschel knitting machine of 14 gauge equipped with 6 guide bars and having a needle cylinder space of 13 mm, false-twisted yarns of poly(ethylene terephthalate) fiber each having a size of 500 dtex/144 filaments and showing a dry heat shrinkage of 5.7% were fed in an all-in arrangement from guide bars (L2, L3) for forming a front side knitted fabric. A monofilament of poly(trimethylene terephthalate) fiber having a size of 390 dtex and having been produced in Reference Example 1 was then fed in an all-in arrangement from a guide bar (L4) for forming a connecting portion. Moreover, false-twisted yarns of poly(ethylene terephthalate) fiber (each prepared by doubling two yarns having a size of 500 dtex/144 filaments) each having a size of 1,000 dtex/288 filaments and showing a dry heat shrinkage of 3.3% were fed in 2-out×2-in (L5) and 2-in×2-out (L6) arrangements from guide bars (L5, L6) for forming a back side knitted fabric.

With the knitting stitch shown below, an insertion yarn (a monofilament of poly(trimethylene terephthalate) fiber having a size of 880 dtex and having been produced in Reference Example 1) was inserted in an all-in arrangement from a guide bar (L1) into the front side knitted fabric in the longitudinal direction at a picking density of 12.7 courses/2.54 cm to give a three-dimensional knitted fabric. The gray fabric thus obtained was tentered by 5%, and dry heat set at 150° C. for 3 minutes to give a one-side mesh-like three-dimensional knitted fabric. Table 2 shows physical properties of the three-dimensional knitted fabric thus obtained.

(Knitting Stitch)

L1: 1111/0000/(all-in)

L2: 1011/3433/(all-in)

L3: 1000/0111/(all-in)

L4: 4367/3410/(all-in)

L5: 3345/4432/2201/1132/(2-out×2-in)

L6: 2201/1132/3345/4432/(2-in×2-out)

Although the three-dimensional knitted fabric thus obtained had had cushioning properties with a resilient feeling, the knitted fabric gave an unpleasant feeling caused by reduction in width or lateral winkles during sitting, was poor in fitting properties, and gave an uncomfortable sitting feeling. Moreover, because lateral wrinkles remained in the knitted fabric, the knitted fabric had a poor appearance.

EXAMPLE 11

Using a raschel knitting machine of 14 gauge equipped with 4 guide bars, raw yarns of poly(ethylene terephthalate) fiber each having a size of 560 dtex/96 filaments and showing a dry heat shrinkage of 10.6% were fed in an all-in arrangement from guide bars (L1, L2) for forming a ground structure. A monofilament of poly(trimethylene terephthalate) fiber having a size of 880 dtex and having been produced in Reference Example 1 was fed in an all-in arrangement from a guide bar (L3) for an insertion yarn.

With the knitting stitch shown below, a gray fabric was knitted at an on-machine course density of 14.0 courses/2.54 cm. The gray fabric thus obtained was dry heat set at 160° C. for 3 minutes with width maintained to give a sheet material for a seat. Table 3 shows physical properties of the sheet material for a seat thus obtained.

(Knitting Stitch)

L1: 10/01/(all-in)

L2: 10/56/(all-in)

L3: 22/00/(all-in)

The sheet material for a seat thus obtained showed a high stretch placing compression penetration stress, had suitable flexibility, was excellent in fitting properties, and gave no unpleasant feeling in the buttocks and had a sitting feeling excellent in stability. Moreover, the sheet material was excellent in recovery after sitting, and had a good appearance utterly without prominent recessed portions.

EXAMPLE 12

The procedure of Example 11 was repeated except that the knitting stitch of an insertion yarn shown below was employed to give a sheet material for a seat. Table 3 shows physical properties of the sheet material for a seat thus obtained.

The sheet material for a seat thus obtained showed a high stretch placing compression penetration stress, had suitable flexibility, was excellent in fitting properties, and gave no unpleasant feeling in the buttocks and had a sitting feeling excellent in stability. Moreover, the sheet material was excellent in recovery after sitting, and had a good appearance approximately without prominent recessed portions.

(Knitting Stitch)

L3: 00/33/(all-in)

EXAMPLE 13

The procedure of Example 11 was repeated except that poly(ethylene terephthalate) false-twisted yarns each having a size of 500 dtex/144 filaments and showing a dry heat shrinkage of 3.5% were fed from guide bars (L1, L2) for forming a ground structure to give a sheet material for a seat. Table 3 shows physical properties of the sheet material for a seat thus obtained.

The sheet material for a seat thus obtained showed a high stretch placing compression penetration stress, had suitable flexibility, was excellent in fitting properties, and gave no unpleasant feeling in the buttocks and had a sitting feeling excellent in stability. Moreover, the sheet material was excellent in recovery after sitting, and had a good appearance approximately without prominent recessed portions.

EXAMPLE 14

The procedure of Example 11 was repeated except that the on-machine course density was made 10.2 courses/2.54 cm to give a sheet material for a seat. Table 3 shows physical properties of the sheet material for a seat thus obtained.

The sheet material for a seat thus obtained showed a high stretch placing compression penetration strength, had suitable flexibility, was excellent in fitting properties, and gave no unpleasant feeling in the buttocks and had a sitting feeling excellent in stability. Moreover, the sheet material was excellent in recovery after sitting, and had a good appearance approximately without prominent recessed portions.

EXAMPLE 15

Using a raschel knitting machine of 14 gauge equipped with a weft yarn inserting machine, raw yarns of poly(ethylene terephthalate) fiber each having a size of 560 dtex/96 filaments and showing a dry heat shrinkage of 10.6% were fed in an all-in arrangement from guide bars (L1, L2) for forming a ground structure. A sheath-core monofilament having a size of 1,060 dtex and having been produced in Reference Example 2 was weft yarn inserted into each course, and the knitting stitch shown below was employed to give a knitted gray fabric at an on-machine course density of 12.7 courses/2.54 cm. The gray fabric thus obtained was dry heat set at 160° C. for 3 minutes with width maintained to give a sheet material for a seat. Table 3 shows physical properties of the sheet material for a seat thus obtained.

(Knitting Stitch)

L1: 10/01/(all-in)

L2: 10/34/(all-in)

The sheet material for a seat thus obtained showed a high stretch placing compression penetration stress, had suitable flexibility, was excellent in fitting properties, and gave no unpleasant feeling in the buttocks and a sitting feeling excellent in stability. Moreover, the sheet material was excellent in recovery after sitting, and had a good appearance utterly without prominent recessed portions.

COMPARATIVE EXAMPLE 8

The procedure of Example 13 was repeated except that false-twisted yarns of poly(ethylene terephthalate) fiber each having a size of 334 dtex/72 filaments and showing a dry heat shrinkage of 3.6% were fed in an all-in arrangement from guide bars (L1, L2) for forming the ground structure to give a sheet material for a seat. Table 3 shows physical properties of the sheet material for a seat thus obtained.

The sheet material for a seat thus obtained showed a considerably low stretch placing compression penetration strength, insufficient surface stiffness, had poor fitting properties, and gave an unstable feeling. Moreover, the sheet material had remaining recessed portions and a poor recovery after sitting.

COMPARATIVE EXAMPLE 9

The procedure of Example 11 was repeated except that the on-machine course density was made 6 courses/2.54 cm to give a sheet material for a seat. Table 3 shows physical properties of the sheet material for a seat thus obtained.

The sheet material for a seat thus obtained showed a low stretch placing compression penetration strength and gave an uncomfortable sitting feeling due to a considerably unpleasant feeling in the buttocks caused by a reduction in width. Moreover, the sheet material was poor in fitting properties, and showed a poor recovery with recessed portions remaining after sitting.

COMPARATIVE EXAMPLE 10

The procedure of Example 11 was repeated except that the insertion yarn was not used to give a sheet material for a seat. Table 3 shows physical properties of the sheet material for a seat thus obtained.

The sheet material for a seat thus obtained showed insufficient surface stiffness, and gave an unstable feeling. Moreover, the sheet material showed a poor recovery with recessed portions remaining after sitting.

COMPARATIVE EXAMPLE 11

The procedure of Example 15 was repeated except that a raw yarn of poly(ethylene terephthalate) fiber having a size of 1,120 dtex/192 filaments and showing a dry heat shrinkage of 10.5% was fed in an all-in arrangement from a guide bar (L1) for forming a ground structure, and that a sheath-core monofilament having a size of 3,230 dtex and having been produced in Reference example 2 was used as a weft yarn insertion yarn to give a sheet material for a seat. Table 3 shows physical properties of the sheet material for a seat thus obtained.

The sheet material for a seat thus obtained was hard because the sheet material showed an excessively high stress at 5% elongation in the A direction and an excessively small stress ratio during elongation in the longitudinal and lateral directions, and was poor in fitting properties during sitting.

EXAMPLE 16

A sheath-core monofilament having a size of 1,820 dtex and prepared in Reference Example 2 was used as a warp yarn, and a doubled and twisted yarn of poly(ethylene terephthalate fiber (prepared by ring twisting 10 false-twisted yarns (Z-twisted) each having a size of 167 dtex/48 filaments under the condition of S-twisting at 300 T/m) having a size of 1,670 dtex/480 filaments was used as a weft yarn. A gray fabric having a plain weave structure was prepared from the yarn.

The gray fabric thus prepared was dry heat set at 160° C., scoured by a jet-dyeing machine, and final set at 160° C. to give a sheet material for a seat. The sheet material for a seat thus obtained had a warp yarn density of 28 ends/2.54 cm and a weft yarn density of 22 picks/2.54 cm. Table 4 shows physical properties of the sheet material for a seat thus obtained.

The sheet material for a seat thus obtained showed a high stretch placing compression penetration strength, had suitable flexibility, was excellent in fitting properties, and gave no unpleasant feeling in the buttocks and a sitting feeling excellent in stability. Moreover, the sheet material was excellent in recovery after sitting, and had a good appearance without prominent recessed portions.

EXAMPLE 17

The procedure of weaving and finish processing in Example 16 was repeated except that a sheath-core monofilament having a size of 1,060 dtex and having been produced as in Reference Example 2 was used as a weft yarn to give a sheet material for a seat. The sheet material for a seat thus obtained had a warp yarn density of 28 ends/2.54 cm and a weft yarn density of 28 picks/2.54 cm. Table 4 shows physical properties of the sheet material for a seat thus obtained.

Similarly to Example 16, the sheet material for a seat thus obtained showed a high stretch placing compression penetration strength, had suitable flexibility, was excellent in fitting properties, and gave no unpleasant feeling in the buttocks and had a sitting feeling excellent in stability. Moreover, the sheet material was excellent in recovery after sitting, and had a good appearance without prominent recessed portions.

EXAMPLE 18

A doubled and twisted yarn of cotton (prepared by doubling four yarns each having a cotton count of 10, and ring twisting under the condition of S-twisting at 300 T/m) was used as a warp yarn and a weft yarn to give a gray fabric having a plain weave structure. The gray fabric was then finish processed to give a sheet material for a seat. The sheet material for a seat thus obtained had a warp density of 34 ends/2.54 cm and a weft yarn density of 24 picks/2.54 cm. Table 4 shows physical properties of the sheet material for a seat thus obtained.

In comparison with the sheet material in Example 16, the sheet material for a seat thus obtained showed a slightly low stretch placing compression penetration strength and a slightly poor recovery. However, the sheet material gave a comfortable sitting feeling excellent in stable feeling.

COMPARATIVE EXAMPLE 12

The procedure of Example 16 such as weaving and finish processing was repeated except that the sheath-core monofilament having a size of 1,820 dtex and used as a warp yarn was used as a weft yarn to give a sheet material for a seat. The sheet material for a seat thus obtained had a warp yarn density of 28 ends/2.54 cm and a weft yarn density of 28 picks/2.54 cm. Table 4 shows physical properties of the sheet material for a seat thus obtained.

The sheet material for a seat thus obtained had particularly poor fitting properties in comparison with those in Example 16.

COMPARATIVE EXAMPLE 13

The procedure of Example 16 such as weaving and finish processing was repeated except that a sheath-core monofilament having a size of 3,230 dtex and having been produced as in Reference Example 2 was used as a warp yarn and a weft yarn to give a sheet material for a seat. The sheet material for a seat thus obtained had a warp density of 28 ends/2.54 cm and a weft yarn density of 28 picks/2.54 cm. Table 4 shows physical properties of the sheet material for a seat thus obtained.

The sheet material for a seat thus obtained was hard and iron plate-like because the sheet material showed an excessively high stress at 5% elongation in the A direction and an excessively small stress ratio during elongation in the longitudinal and lateral directions, and was poor in fitting properties during sitting.

COMPARATIVE EXAMPLE 14

A sheath-core monofilament having a size of 1,060 dtex and produced in Reference Example 2 was used as a warp yarn, and a doubled and twisted yarn of poly(ethylene terephthalate) fiber (prepared by ring twisting five false-twisted yarns (Z-twisted) each having a size of 167 dtex/48 filaments under the conditions of S-twisting at 300 T/m) having a size of 835 dtex/240 filaments was used as a weft yarn; and a gray fabric of a plain weave structure was prepared.

The gray fabric thus prepared was dry heat set at 160° C., scoured by a jet-dyeing machine, and final set at 160° C. to give a sheet material for a seat. The sheet material for a seat thus obtained had a warp yarn density of 9 ends/2.54 cm and a weft yarn density of 8 picks/2.54 cm. Table 4 shows physical properties of the three-dimensional knitted fabric thus obtained.

The sheet material for a seat thus obtained showed a considerably low stretch placing compression penetration strength, an insufficient surface stiffness, had poor fitting properties, gave a poor stable feeling, and showed a poor recovery because recessed portions remained after sitting.

TABLE 1

| | | | | Ex.1 | Ex.2 | Ex.3 | Ex.4 | Ex.5 | Ex.6 | Ex.7 | Ex.8 |
|---|---|---|---|---|---|---|---|---|---|---|---|
| Yarn use | Front side knitted fabric | Ground yarn | Size(dtex/f) | 500/144 | 500/144 | 500/144 | 500/144 | 500/144 | 500/90 | 500/90 | 500/144 |
| | | | Shape* | FT | FT | FT | FT | FFT | YDFT | YDFT | FT |
| | | PET | Dry heat shrinkage (%) | 3.3 | 3.3 | 3.3 | 3.3 | 5.3 | 1.8 | 1.8 | 3.3 |
| | | Insertion yarn | | — | — | — | — | — | — | — | — |
| | Size of connecting yarn(dtex) | | | PTT390 | PTT390 | PTT390 | PTT390 | PTT390 | PTT390 | PTT390 | PTT390 |
| | Back side knitted fabric | Ground yarn | Size(dtex/f) | 500/144 | 500/144 | 500/144 | 500/144 | 500/144 | 500/90 | 500/90 | 560/96 |
| | | | Shape* | FT | RY | RY | RY | FFT | YDFT | YDFT | RY |
| | | PET | Dry heat shrinkage (%) | 5.7 | 13.8 | 13.8 | 13.8 | 5.3 | 1.8 | 1.8 | 11.7 |
| | | Size of insertion yarn(dtex/f) | | 880 | 390 | 390 | 390 | 390 | 167/48 | 167/48 | 390 |
| | | (number of yarns, insertion direction**) | | (1, Wp) | (2, Wp) | (2, Wp) | (2, Wp) | (2, Wp) | (8, Wf) | (12, Wf) | (2, Wp) |

TABLE 1-continued

| | | Ex.1 | Ex.2 | Ex.3 | Ex.4 | Ex.5 | Ex.6 | Ex.7 | Ex.8 |
|---|---|---|---|---|---|---|---|---|---|
| Stress at 5% elongation | Longitudinal | 107 | 206 | 203 | 225 | 54 | 9.8 | 46 | 155 |
| (N/4 cm width) | Lateral | 13.2 | 29 | 118 | 49 | 10.2 | 142 | 220 | 38 |
| Ratio of stress at 5% elongation | A/B | 8.1 | 7.1 | 1.7 | 4.6 | 5.3 | 14.5 | 4.8 | 4.1 |
| Reduction in width H (%) | | 8.0 | 4.9 | 5.6 | 5.3 | 11.3 | 6.2 | 4.4 | 5.4 |
| Stretch placing compression penetration strength G(N) | | 4650 | 6680 | 8090 | 7220 | 4410 | 6990 | 7310 | 8110 |
| Surface elongation (%) | Front side knitted fabric F | 10.2 | 10.1 | 10.1 | 12.7 | 12.6 | 9.7 | 12.9 | 9.9 |
| | Back side knitted fabric D | 2.8 | 2.3 | 2.5 | 2.3 | 3.5 | 2.5 | 1.6 | 2.3 |
| Surface elongation ratio | F/D | 3.6 | 4.4 | 4.0 | 5.5 | 3.6 | 3.9 | 9.2 | 4.3 |
| Compressive elastic modulus E(N/mm) | | 46.8 | 53.1 | 49.0 | 49.2 | 71.2 | 66.3 | 68.8 | 130 |
| Evaluation of wrinkles | | ○ | ○ | ○ | ○ | ○ | ○ | ○ | ◎ |
| Fitting properties during sitting | | ○ | ◎ | ◎ | ◎ | ○ | ◎ | ◎ | ◎ |
| Unpleasant feeling during sitting | | ○ | ◎ | ◎ | ◎ | ○ | ◎ | ◎ | ◎ |
| Stable feeling during sitting | | ○ | ◎ | ◎ | ◎ | ○ | ◎ | ◎ | ◎ |
| Recovery (appearance) | | ○ | ◎ | ◎ | ◎ | ○ | ◎ | ◎ | ◎ |

Note:

*FT = false-twisted yarn, FFT = flame-retardant false-twisted yarn, YDFT = yarn-dyeing false-twisted yarn, RY = raw yarn

**Wp = warp, Wf = weft

TABLE 2

| | | | | Ex.9 | Ex.10 | C.Ex.1 | C.Ex.2 | C.Ex.3 | C.Ex.4 | C.Ex.5 | C.Ex.6 | C.Ex.7 |
|---|---|---|---|---|---|---|---|---|---|---|---|---|
| Yarn use | Front side knitted fabric | Ground yarn PET | Size(dtex/f) | 500/144<br>560/96 | 560/96 | 500/144 | 500/144 | 500/144 | 500/144 | 500/144 | 500/144 | 500/144 |
| | | | Shape* | FT<br>RY | RY | FT | FT | FT | FT | FT | FT | FT |
| | | | Dry heat shrinkage (%) | 3.3<br>11.7 | 11.7 | 3.3 | 3.3 | 3.3 | 3.3 | 3.3 | 3.3 | 5.7 |
| | | Size of insertion yarn(dtex/f) (number of yarns, insertion direction) | | — | — | — | — | — | — | — | 167/48 (5, Wf) | 880 (1, Wp) |
| | Size of connecting yarn(dtex) | | | PTT390 | PTT390 | PTT390 | PTT390 | PTT390 | PTT390 | PTT390 | PTT390 | PTT390 |
| | Back side knitted fabric | Ground yarn PET | Size(dtex/f) | 500/144 | 500/144 | 500/144 | 500/144 | 500/144 | 500/144 | 500/144 | 500/144 | 500/144 |
| | | | Shape* | FT | FT | FT | FT | FT | RY | FT | FT | FT |
| | | | Dry heat shrinkage (%) | 3.3 | 3.3 | 5.7 | 5.7 | 5.7 | 13.8 | 3.3 | 3.3 | 3.3 |
| | | Size of insertion yarn(dtex/f) (number of yarns, insertion direction**) | | 390 (2, Wp) | 390 (2, Wp) | — | 167/48 (1, Wf) | — | 167/48 (12, Wf) | 167/48 (12, Wf) | 880 (1, Wp) | — |
| Stress at 5% elongation (N/4 cm width) | Longitudinal | | | 65 | 46 | 20.3 | 20.6 | 21.2 | 54 | 19.8 | 97.6 | 101.8 |
| | Lateral | | | 12.5 | 17 | 8.5 | 19.0 | 1.1 | 325 | 323 | 90.5 | 5.7 |
| Ratio of stress at 5% elongation | A/B | | | 5.2 | 2.7 | 2.4 | 1.1 | 19.3 | 6.0 | 16.3 | 1.1 | 17.9 |
| Reduction in width H (%) | | | | 7.6 | 5.2 | 16.0 | 15.7 | 16.0 | 1.3 | 1.5 | 4.4 | 12.1 |
| Stretch placing compression penetration strength G(N) | | | | 6420 | 7540 | 4350 | 4420 | 3670 | 7320 | 6980 | 8150 | 5840 |
| Surface elongation (%) | Front side knitted fabric F | | | 5.5 | 4.1 | 10.1 | 10.2 | 10.4 | 6.4 | 6.5 | 3.1 | 12.6 |
| | Back side knitted fabric D | | | 2.7 | 2.6 | 4.3 | 3.6 | 5.4 | 0.9 | 1.1 | 2.8 | 2.7 |
| Surface elongation ratio | F/D | | | 2.0 | 1.6 | 2.3 | 2.8 | 1.9 | 7.1 | 5.9 | 1.1 | 4.7 |
| Compressive elastic modulus E(N/mm) | | | | 41.7 | 39.1 | 42.7 | 44.4 | 42.8 | 56.6 | 55.9 | 77.7 | 50.2 |
| Evaluation of wrinkles | | | | ○ | ○ | ◎ | ◎ | ◎ | ○ | ○ | ○ | X |
| Fitting properties during sitting | | | | ◎ | ○ | X | Δ | X | X | X | X | Δ |
| Unpleasant feeling during sitting | | | | ◎ | ◎ | X | Δ | X | ◎ | ◎ | ◎ | Δ |
| Stable feeling during sitting | | | | ○ | ◎ | X | X | X | ◎ | ◎ | ◎ | Δ |
| Recovery (appearance) | | | | ○ | ◎ | X | X | X | ◎ | ◎ | ◎ | Δ |

Note:

*RY = raw yarn, FT = false-twisted yarn

**Wp = warp, Wf = weft

TABLE 3

| | | Ex.11 | Ex.12 | Ex.13 | Ex.14 | Ex.15 | C.Ex.8 | C.Ex.9 | C.Ex.10 | C.Ex.11 |
|---|---|---|---|---|---|---|---|---|---|---|
| Yarn use | Ground structure* | RY | RY | FT | RY | RY | FT | RY | RY | RY |
| | (ground yarn: PET) | 560/96 | 560/96 | 500/144 | 560/96 | 560/96 | 334/72 | 560/96 | 560/96 | 1120/192 |
| | Dry heat shrinkage (%) | 10.6 | 10.6 | 3.5 | 10.6 | 10.6 | 3.5 | 10.6 | 10.6 | 10.6 |
| | Size of insertion yarn# (dtex/f) (number of yarns, insertion direction**) | PTT880 (1, Wp) | PTT880 (1, Wp) | PTT880 (1, Wp) | PTT880 (1, Wp) | Sheath-core 1060 (1, Wf) | PTT880 (1, Wp) | PTT880 (1, Wp) | — | Sheath-core 3230 (1, Wf) |
| Stress at 5% elongation (N/4 cm width) | Longitudinal | 226.4 | 108.9 | 75.7 | 79.9 | 146.6 | 63.8 | 26.7 | 34.5 | 310.8 |
| | Lateral | 123.0 | 58.2 | 8.0 | 10.4 | 234.8 | 4.0 | 1.7 | 5.3 | 315.2 |
| Ratio of stress at 5% elongation | A/B | 1.8 | 1.9 | 9.5 | 7.7 | 1.6 | 16.0 | 15.7 | 6.5 | 1.0 |
| Reduction in width H (%) | | 5.3 | 6.2 | 8.5 | 6.8 | 4.2 | 15.2 | 15.5 | 10.5 | 1.3 |
| Stretch placing compression penetration strength G(N) | | 7290 | 8320 | 6990 | 5840 | 6890 | 2680 | 2910 | 5470 | 11020 |
| Fitting properties during sitting | | ◎ | ◎ | ○ | ○ | ○ | Δ | X | Δ | X |
| Unpleasant feeling during sitting | | ◎ | ◎ | ○ | ○ | ◎ | Δ | X | Δ | ◎ |
| Stable feeling during sitting | | ◎ | ○ | ○ | ○ | ◎ | X | X | X | ◎ |
| Recovery (appearance) | | ◎ | ○ | ○ | ○ | ◎ | X | X | X | ◎ |

Note:
*RY = raw yarn, FT = false-twisted yarn
#Sheath-core = sheath-core monofilament
**Wp = warp, Wf = weft

TABLE 4

| | | | Ex.16 | Ex.17 | Ex.18 | C.Ex.12 | C.Ex.13 | C.Ex.14 |
|---|---|---|---|---|---|---|---|---|
| Yarn use | Warp yarn | Size (dtex/f) | 1820/1 | 1820/1 | Yarn of cotton count 10 × 4 doubled and twisted yarn | 1820/1 | 3230/1 | 1060/1 |
| | | Shape* | Sheath-core | Sheath-core | | Sheath-core | Sheath-core | Sheath-core |
| | Weft yarn | Size (dtex/f) | 1670/480 | 1060/1 | Yarn of cotton count 10 × 4 doubled and twisted yarn | 1820/1 | 3230/1 | 835/240 |
| | | Shape* | FT→DT | Sheath-core | | Sheath-core | Sheath-core | FT→DT* |
| Stress at 5% elongation (N/4 cm width) | | Longitudinal | 218.8 | 223.2 | 60.2 | 219.9 | 344.4 | 37.4 |
| | | Lateral | 94.5 | 134.3 | 233.7 | 221.8 | 358.2 | 17.2 |
| Ratio of stress at 5% elongation | | A/B | 2.3 | 1.7 | 3.9 | 1.0 | 1.0 | 2.2 |
| Reduction in width H (%) | | | 2.6 | 2.3 | 3.6 | 2.2 | 1.3 | 4.0 |
| Stretch placing compression penetration strength G(N) | | | 4470 | 4110 | 3080 | 4240 | 5950 | 2430 |
| Fitting properties during sitting | | | ◎ | ○ | ○ | Δ | X | Δ |
| Unpleasant feeling during sitting | | | ◎ | ◎ | ◎ | ◎ | ◎ | ○ |
| Stable feeling during sitting | | | ◎ | ◎ | ◎ | ◎ | ◎ | Δ |
| Recovery (appearance) | | | ◎ | ◎ | ○ | ◎ | ◎ | X |

Note:
*Sheath-core = sheath-core monofilament, FT = false twisting, DT = doubling and twisting

INDUSTRIAL APPLICABILITY

The sheet material for a seat of the present invention can be appropriately used for seats for automobiles, railway vehicles and aircrafts, child seats, baby cars, wheelchairs, or the like, and furniture, chairs for office use, and the like, and shows excellent cushioning properties. In addition to the above applications, the sheet material for a seat composed of a three-dimensional knitted fabric can also be appropriately used for shoulder pats, brassier cups, a cushioning material for legazes, a cushioning material for supporters, a lining material for heat-retaining clothes, etc., a lining of helmets, a cushioning material contacted with a human body such as human body-protecting pads, buffering material, a shape-retaining material, a heat-retaining material, and the like.

The invention claimed is:

1. A sheet material for a seat comprising a sheet material formed out of a knitted fabric in which an insertion yarn is used, a ground structure forming the knitted fabric being formed out of a combined texture of chain stitch in every course in at least one guide bar of a knitting machine and knitting stitch of 3-8 needle shogging in every course in at least one other guide bar of the knitting machine, the insertion yarn being a warp yarn inserted in a direction equal to or reverse to an underlap direction of the knitting stitch of the ground structure with a shopping width of 3 needle shopping or less per course, and the sheet material having a stress at 5% elongation (A) of from 40 to 300 N/4 cm width, where A is a stress measured in a longitudinal direction and a ratio A/B is from 1.5 to 15.0, where B is a stress measured in a lateral direction and a reduction in width (H) of from 0 to 15% when the sheet material is fixed on a frame at one end and at an opposite end while being stretched and pressured.

2. The sheet material for a seat according to claim 1, wherein the sheet material is a three-dimensional knitted fabric having front and back double layer knitted fabrics and a connecting yarn that connects the double layer knitted fabrics.

3. The sheet material for a seat according to claim 2, wherein the connecting yarn is a monofilament.

4. The sheet material for a seat according to claim 1, wherein the insertion yarn is a monofilament of 300 to 3,000 dtex.

5. The sheet material for a seat according to claim 1, wherein a penetration strength (G) is 3,000 N or more when the sheet material is fixed on the frame while being stretched and pressured.

6. The sheet material for a seat according to claim 2, wherein the sheet material is a three-dimensional knitted fabric that shows a ratio (F/D) of a surface elongation (F) of a front side knitted fabric to a surface elongation (D) of a back side knitted fabric of 1.5 to 10.0.

7. The sheet material for a seat according to claim 6, wherein the sheet material is a three-dimensional knitted fabric showing a compression modulus of 20 to 150 N/mm.

8. The sheet material for a seat according to claim 6 or 7, wherein the sheet material is a three-dimensional knitted fabric for which a poly(trimethylene terephthalate) monofilament is used as the connecting yarn.

9. A seat comprising a seat formed out of the sheet material according to claim 1.

10. The sheet material for a seat according to claim 1, wherein the product of a number of courses and a number of wales of the knitted fabric is from 120 to 500.

* * * * *